US009685727B2

(12) United States Patent
Stowers et al.

(10) Patent No.: US 9,685,727 B2
(45) Date of Patent: Jun. 20, 2017

(54) HIGH SPEED DATA CONTACT SET WITH RIGHT ANGLE TERMINATION INSERT

(71) Applicant: Virginia Panel Corporation, Waynesboro, VA (US)

(72) Inventors: Jeffery P Stowers, Mount Sidney, VA (US); Darryl M Ashby, Weyers Cave, VA (US); David L Rocker, Earlysville, VA (US); Christopher Church-Diciccio, Waynesboro, VA (US)

(73) Assignee: Virginia Panel Corporation, Waynesboro, VA (US)

( * ) Notice: Subject to any disclaimer, the term of this patent is extended or adjusted under 35 U.S.C. 154(b) by 0 days.

(21) Appl. No.: 15/005,718

(22) Filed: Jan. 25, 2016

(65) Prior Publication Data

US 2016/0141808 A1 May 19, 2016

Related U.S. Application Data

(63) Continuation-in-part of application No. 14/496,178, filed on Sep. 25, 2014, now Pat. No. 9,246,286.

(60) Provisional application No. 61/882,091, filed on Sep. 25, 2013, provisional application No. 61/901,723, filed on Nov. 8, 2013.

(51) Int. Cl.

| | |
|---|---|
| ***H01R 13/514*** | (2006.01) |
| ***H01R 24/84*** | (2011.01) |
| *H01R 13/504* | (2006.01) |
| *H01R 13/627* | (2006.01) |

(52) U.S. Cl.

CPC ..... *H01R 13/514* (2013.01); *H01R 24/84* (2013.01); *H01R 13/504* (2013.01); *H01R 13/6273* (2013.01)

(58) Field of Classification Search

CPC ..... H01R 13/514; H01R 24/84

See application file for complete search history.

(56) References Cited

U.S. PATENT DOCUMENTS

| | | | |
|---|---|---|---|
| 4,329,005 | A | 5/1982 | Braginetz |
| 5,562,458 | A | 10/1996 | Stora |
| 5,966,023 | A | 10/1999 | Burgers et al. |
| 7,153,152 | B1 | 12/2006 | Eby et al. |

(Continued)

FOREIGN PATENT DOCUMENTS

| | | |
|---|---|---|
| EP | 2058904 A2 | 5/2009 |
| EP | 2161788 Al | 3/2010 |

*Primary Examiner* — Ross Gushi

(74) *Attorney, Agent, or Firm* — 24IP Law Group; Timothy R DeWitt

(57) ABSTRACT

A high speed data contact assembly having a linear data contact set and a right-angle termination insert. The linear data contact set has a housing having a hollow body and a termination subassembly. The termination subassembly is inserted in the hollow body of the housing. The termination subassembly has a plurality of pairs of parallel contact beams, the contact beams in each pair being of the same orientation and the pairs of contact beams having alternating orientations, wherein each contact beam has a distal end having a first orientation and a proximal end having a second orientation opposite of the first orientation. The right angle termination insert is adapted for insertion into the proximal end of the linear data contact set. The right angle termination insert has a u-shaped housing and a right-angle contact insert assembly in the U-shaped housing.

5 Claims, 28 Drawing Sheets

(56) References Cited

U.S. PATENT DOCUMENTS

| | | | |
|---|---|---|---|
| 7,297,014 | B1 | 11/2007 | Stowers et al. |
| 7,316,579 | B2 | 1/2008 | Roath et al. |
| 8,348,693 | B2 | 1/2013 | Stowers |
| 2009/0053937 | A1 | 2/2009 | Tsou et al. |
| 2010/0194417 | A1 | 8/2010 | Stowers et al. |
| 2010/0248522 | A1 | 9/2010 | Crofoot et al. |
| 2011/0177699 | A1 | 7/2011 | Crofoot et al. |
| 2013/0102177 | A1 | 4/2013 | Venaleck et al. |
| 2013/0102199 | A1 | 4/2013 | Venaleck et al. |

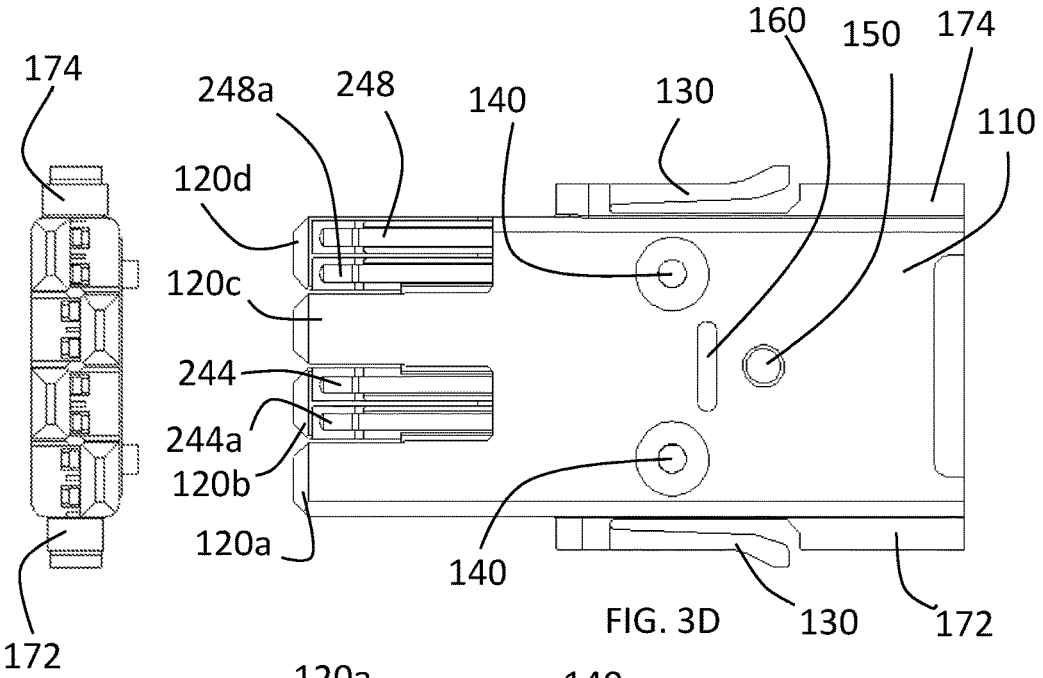
FIG. 3D
FIG. 3F
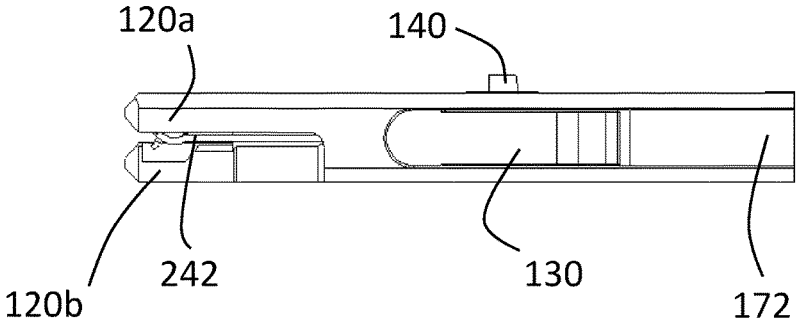
FIG. 3E

HIGH SPEED DATA CONTACT SET WITH RIGHT ANGLE TERMINATION INSERT

CROSS-REFERENCE TO RELATED APPLICATIONS

The present application is a continuation-in-part of U.S. Pat. No. 9,246,286, which claims the benefit of the filing dates of U.S. Provisional Patent Application Ser. No. 61/882,091 filed by the present inventors on Sep. 25, 2013 and U.S. Provisional Patent Application Ser. No. 61/901,723 filed by the present inventors on Nov. 8, 2013.

The aforementioned patent applications are hereby incorporated by reference in their entirety.

STATEMENT REGARDING FEDERALLY SPONSORED RESEARCH OR DEVELOPMENT

None.

BACKGROUND OF THE INVENTION

Field of the Invention

The present invention relates to high-speed data contacts, and more particularly, high speed contact sets or modules for use with high life-cycle or mass interconnect devices.

Brief Description of the Related Art

A variety of high speed data contacts have been developed and used along with various modules for housing such high speed data contacts. Examples include those disclosed in U.S. Patent Application Publication No. 2013/0102199, entitled "Hermaphroditic Interconnect System," U.S. Patent Application Publication No. 2011/0177699 entitled "Backplane Cable Interconnection," U.S. Patent Application Publication No. 2010/0248522 entitled "Electrical Cable Connection Latch System" and U.S. Pat. No. 7,316,579, entitled "Zero Insertion Force Cable Interface." Additional high speed data contact system are known, for example, as the "FCI Examax." While these prior high speed data contact systems had various advantages, none were specifically adapted for use in high life cycle systems designed to perform for thousands or tens of thousands of connection cycles or for mass interconnect systems.

A variety of high life cycle and mass interconnect devices for use with various contacts are known. One example of a conventional high life-cycle interconnect device or interface system is the mass interconnect device disclosed in U.S. Pat. No. 4,329,005, entitled "Slide Cam Mechanism for Positioning Test Adapter in Operative Relationship with a Receiver." Other prior art engagement systems include those disclosed in U.S. Pat. No. 5,966,023, U.S. Pat. No. 5,562,458, U.S. Pat. No. 7,297,014, U.S. Patent Application Publication No. 2010/0194417 and U.S. Pat. No. 8,348,693.

SUMMARY OF THE INVENTION

In a preferred embodiment, the present invention is a high speed data contact set. The high speed data contact set is hermaphroditic and may be used on both the receiver and test adapter sides of an interface. The high speed data contact set comprises an insert shroud having a hollow body for receiving a termination subassembly. The hollow body has a top, a bottom, a front, a rear, and first side and a second side. A plurality of protective arms extend from the front of the hollow body for protecting contact beams of a termination subassembly inserted into the insert shroud. Each protective arm has beveled edges at its distal end and an angled shoulder spaced from its distal end. The beveled edges provide a first stage of contact pre-alignment during engagement and the shoulder provides a second stage of contact pre-alignment during engagement. The insert shroud body further has a plurality of raised bosses on its top for engaging with a plurality of hollows in the bottom of an adjacent insert shroud. The terms "top" and "bottom" are used herein merely to identify different sides of the insert shroud and are not used to imply any particular orientation of the insert shroud. The insert shroud further has a latch on each of the first and second sides of the hollow body for locking the insert shroud into a module after insertion. The high speed data contact set may further comprise a first keying member on the first side of the hollow body and a second keying member on the second side of the hollow body. The insert shroud may further comprise a hole for injecting potting material.

A termination subassembly is inserted into the insert shroud. Potting material may be injected into the insert shroud around the termination subassembly through an opening or hole in the hollow body that may be of any shape. The termination subassembly has a plurality of pairs of contact beams, the contact beams in each pair being of the same orientation and the pairs of contact beams having alternating orientations. The termination subassembly may have a welded wire termination or a double beam contact termination.

In a preferred embodiment, the present invention is a high speed data contact assembly. The assembly has a linear data contact set and a right-angle termination insert. The linear data contact set is hermaphroditic. The linear data contact set has a housing and a termination subassembly. The housing is a hollow body having a top, a bottom, a distal end, a proximal end, and first side and a second side. The termination subassembly is inserted in the hollow body of the housing. The termination subassembly has a plurality of pairs of parallel contact beams, the contact beams in each pair being of the same orientation and the pairs of contact beams having alternating orientations, wherein each contact beam has a distal end having a first orientation and a proximal end having a second orientation opposite of the first orientation. The right angle termination insert is adapted for insertion into the proximal end of the linear data contact set. The right angle termination insert has a u-shaped housing and a right-angle contact insert assembly in the U-shaped housing. The right-angle contact insert assembly has a plurality of right angle contact beams each having a distal end and a proximal end, wherein the proximal end of each of the plurality of right-angle contact beams extends at a right angle to the distal end of each the contact beam and over molding over the plurality of contacts. Further, the over molding may have a plurality of holes filled with potting material.

Still other aspects, features, and advantages of the present invention are readily apparent from the following detailed description, simply by illustrating a preferable embodiments and implementations. The present invention is also capable of other and different embodiments and its several details can be modified in various obvious respects, all without departing from the spirit and scope of the present invention. Accordingly, the drawings and descriptions are to be regarded as illustrative in nature, and not as restrictive. Additional objects and advantages of the invention will be set forth in part in the description which follows and in part will be obvious from the description, or may be learned by practice of the invention.

BRIEF DESCRIPTION OF THE DRAWINGS

For a more complete understanding of the present invention and the advantages thereof, reference is now made to the following description and the accompanying drawings, in which:

FIG. 3D is a top view of a high speed data contact set in accordance with a preferred embodiment of the present invention.

FIG. 3E is a first side view of a high speed data contact set in accordance with a preferred embodiment of the present invention.

FIG. 3F is a front view of a high speed data contact set in accordance with a preferred embodiment of the present invention.

DETAILED DESCRIPTION OF THE PREFERRED EMBODIMENTS

Figure 1:
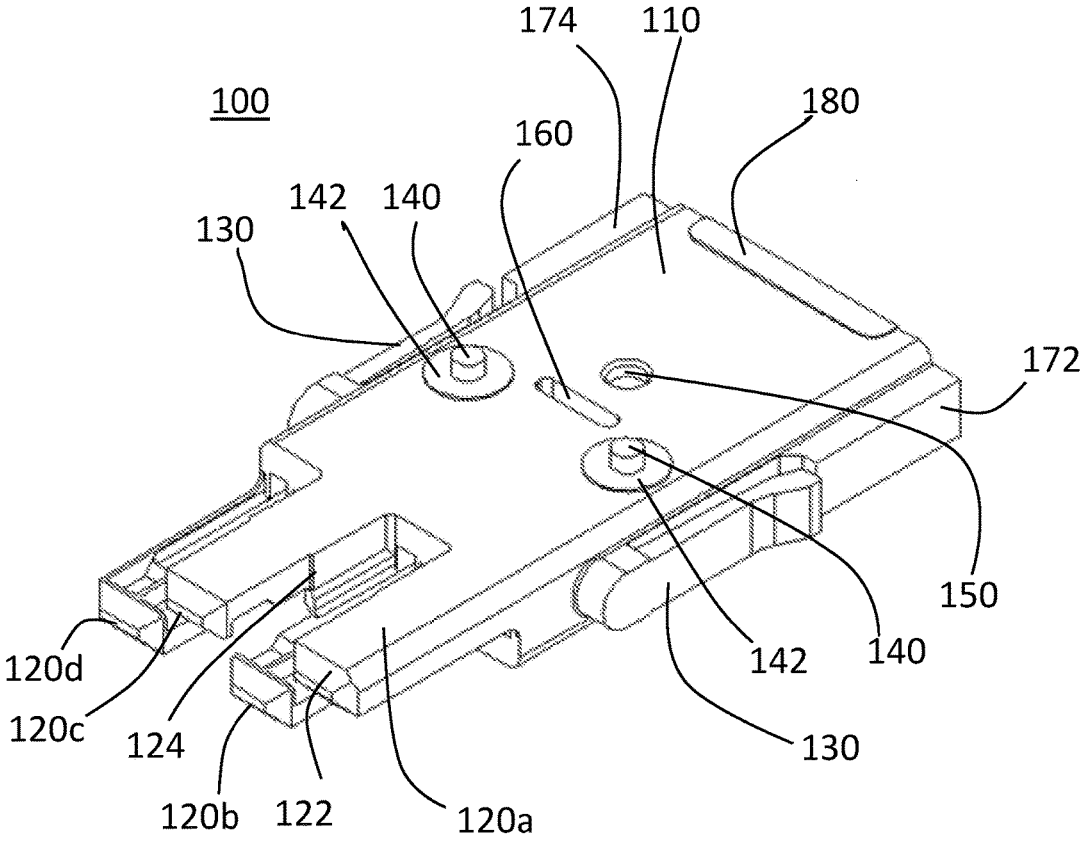
FIG. 1 is a perspective view of a shroud or housing for a high speed data contact set in accordance with a preferred embodiment of the present invention.

In a preferred embodiment the present invention is a high speed data contact set for use with high life cycle or mass interconnect systems. The high speed data contact set, sometimes referred to as a chiclet, of a preferred embodiment of the present invention has a housing or shroud 100 that includes multi-stage lead-in features and controlled float to pre-align contacts during engagement and thereby extends the cycle life of the contacts. The housing, shown in FIG. 1, is formed, for example, from a non-conductive material such as plastic. The housing 100 has a hollow body 110 having a plurality of protective arms 120*a*, 120*b*, 120*c*, and 120*d* extending from the distal portion of the body 110. The end of each protective arm 120*a*, 120*b*, 120*c*, and 120*d* has one or more beveled or angles edges 122 for providing a first stage of pre-alignment of contacts during engagement, for example, with another chiclet. On each side of each protective arm there is an angled shoulder 124 for providing a second stage of pre-alignment of contacts. The housing body 110 has a latch 130 on each side for holding the latch in a module after insertion. The latches 130 are biased away from the body 110 and have angled portions 132 extending away from the hollow body 110. The portions 132 may include beveled or angled corners and edges to prevent snagging and/or breakage when the shroud is removed from a module. The latches make the insert shrouds individually removable from a module of a receiver or test adapter frame. Also on each side, the housing body 110 has keying members 172, 174. The two module keying members 172 and 174 are of different sizes, as shown in FIG. 3F, thereby allowing insertion of the chiclet into a module in only one orientation, thereby preventing human errors in setting up an interface system. On top of the housing body 110 are two raised bosses 140 for providing alignment of the housing body 110 with an adjacent housing body when a plurality of chiclets are stacked together. At the base of each raised boss 140 is an annular spacing ridge 142. The top of the housing body 110 further has a hole 150 through which potting material may be injected. Also on the top of the housing body 110 is a slot 160 that may be used, for example, to release another connector that has been inserted into the rear of the insert shroud, such as is shown in FIGS. 9A-9L. At the proximal end, the housing body 110 has a ridge or raised portion 180 corresponding to the height of the annular ridges 142.

Figure 2A:
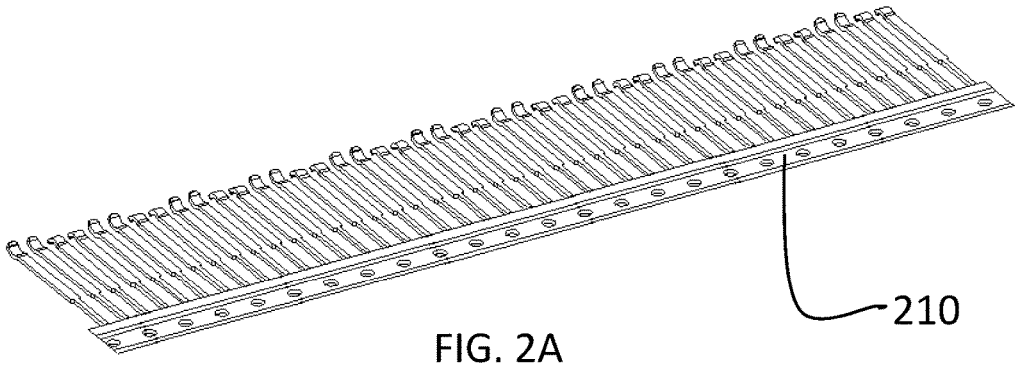
FIG. 2A is a perspective view of a sheet of high speed contacts in accordance with a preferred embodiment of the present invention.
Figure 2B:
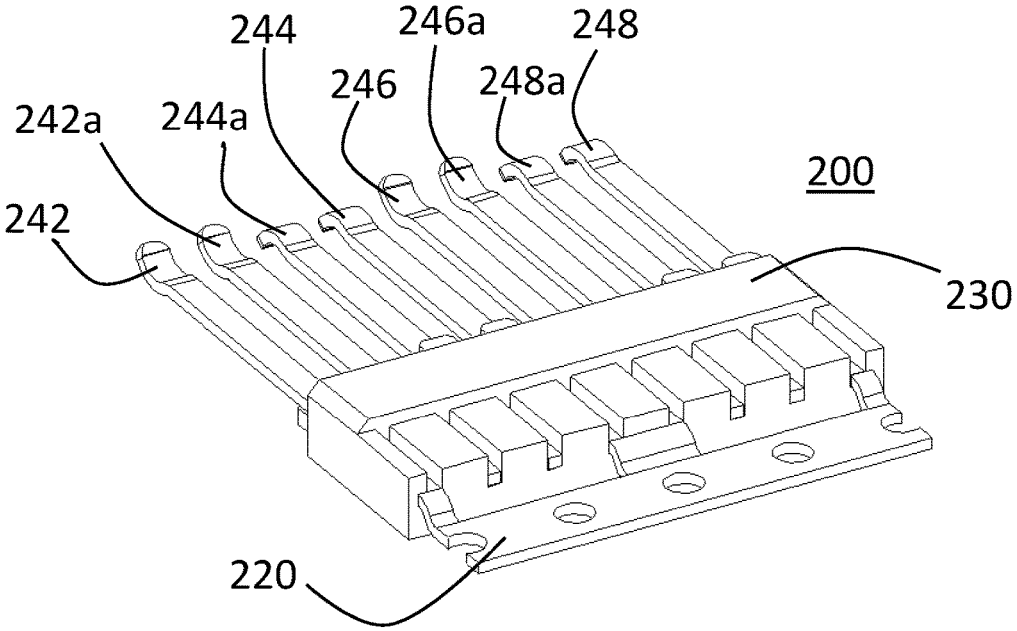
FIG. 2B is a perspective view of an termination subassembly for a high speed data contact set in accordance with a preferred embodiment of the present invention.
Figure 2C:
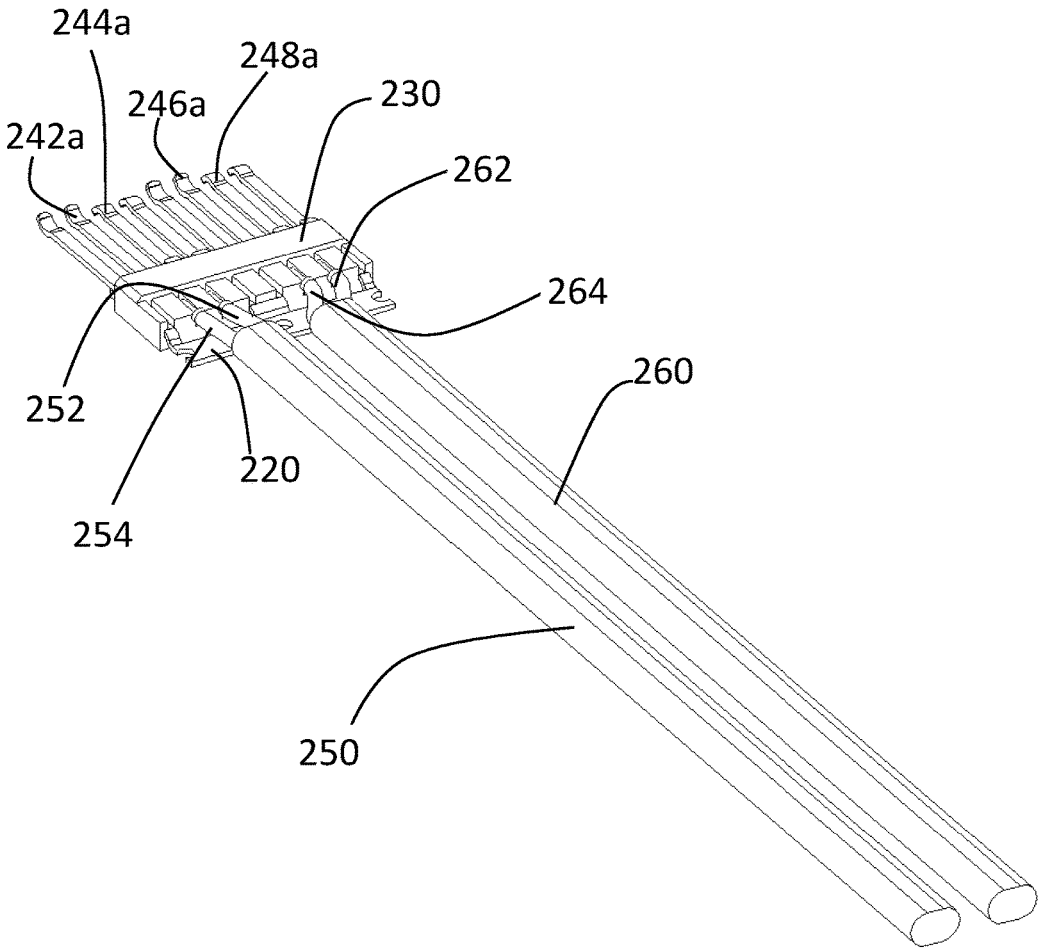
FIG. 2C is a perspective view of a wired termination subassembly for a high speed data contact set in accordance with a preferred embodiment of the present invention.

The high speed data contact set has a termination subassembly 200, shown in FIG. 2B. A sheet 210 of contacts are formed by known means. On the sheet, the contacts are formed in a load balanced alternating two up/two down pattern. As will be described later, this pattern allows the high speed data contact set to be hermaphroditic such that the same high speed data contact set or chiclet may be used on both the receiver side and test adapter side of an interface and can connect to one another. A set of eight contacts 242, 242*a*, 244*a*, 244, 246, 246*a*, 248*a*, 248 is cut from the sheet 210, the set having the two up two down pattern of contacts. The eight contact beams in the set initially are connected to one another by shield 220. The eight contact beams are in a row (wafer shape) and can carry differential signal pairs at speeds of 10 Gigabits per second. A termination subassembly body 230 is molded on and around the contacts as shown in FIG. 2B. The termination subassembly body is formed of a non-conductive or insulating material such as plastic. After molding of the insert body assembly 230 onto the contact set four of the contacts, 242*a*, 244*a*, 246*a* and 248*a*, are disconnected from the shield 220. Contacts 242, 244, 246 and 248 remain connected to one another by the shield by cutting the beams adjacent the shield. An exemplary wiring of the termination subassembly is shown in FIG. 2C. Contacts 242*a* and 244*a* are direct welded to wires 252, 254 in bundle 250 and contacts 246*a* and 248*a* are direct welded to wires 262, 264 in bundle 260. The direct welded termination allows for optimum electrical performance enabling high data rates. The high data rates are achieved because the direct welding fused the standard industry cable conductor material directly to the contact beams without introduction of another material such as solder. While the direct welding is preferred, other types of connected besides direct welding may be used. The termination subassembly is compatible with most standard industry connectors and cables, including but not limited to USB, HDMI, SATA, RJ45, Gigabit Ethernet, DVI and QSFP.

Figure 3A:
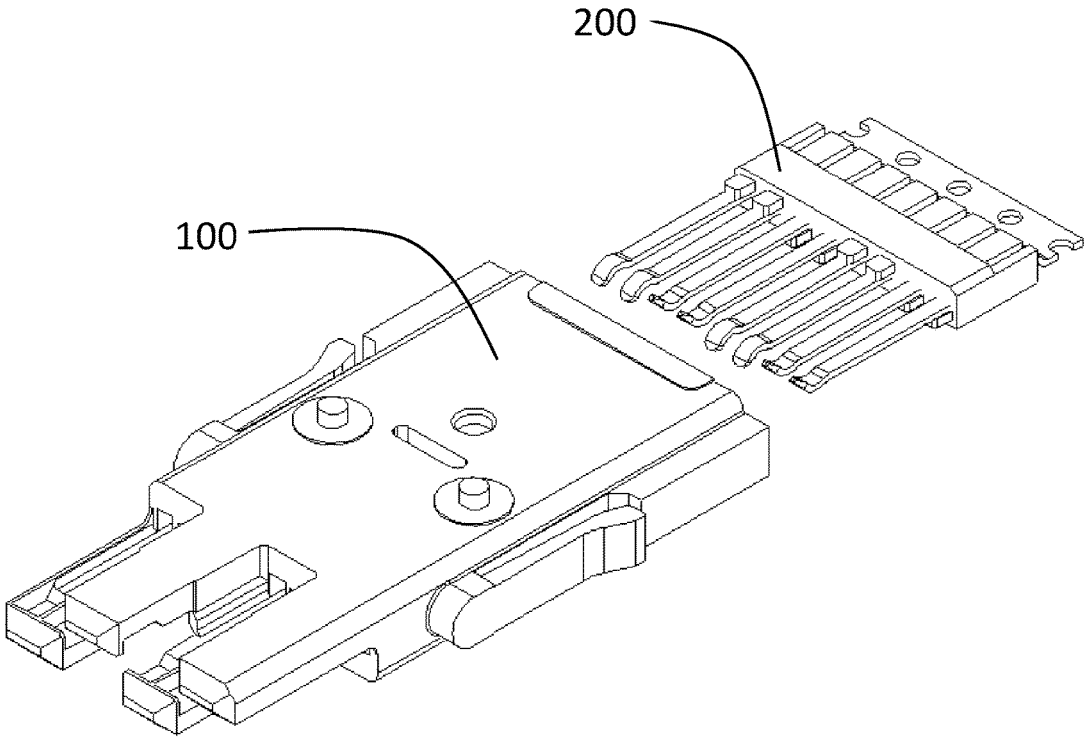
FIG. 3A is a perspective view of an termination subassembly and housing for a high speed data contact set in accordance with a preferred embodiment of the present invention prior to the termination subassembly being inserted into the housing.
Figure 3B:
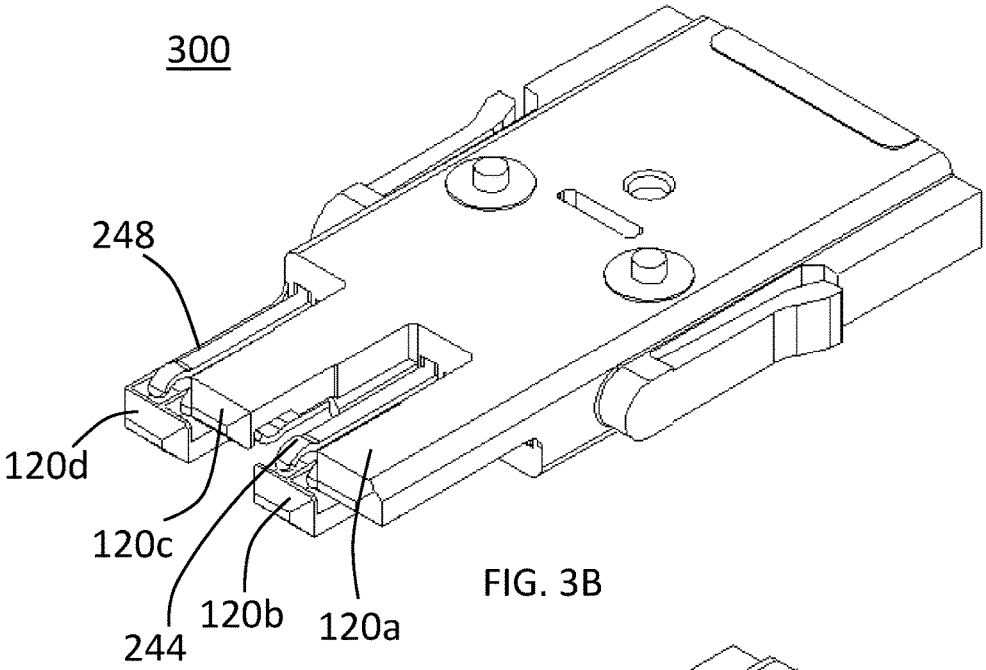
FIG. 3B is a perspective view of a high speed data contact set in accordance with a preferred embodiment of the present invention.
Figure 3C:
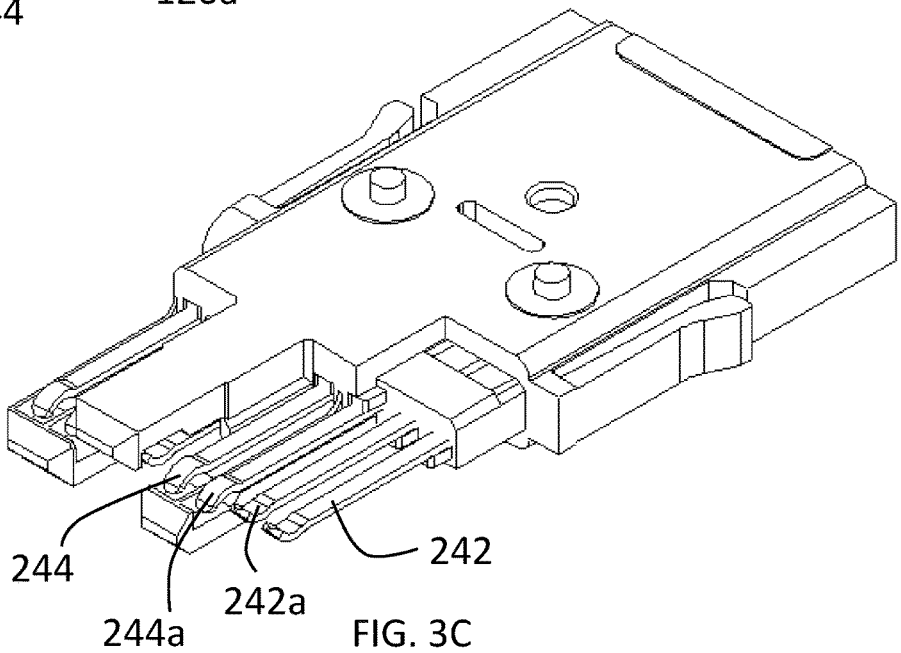
FIG. 3C is a perspective view of a high speed data contact set in accordance with a preferred embodiment of the present invention with one protective arm of the housing cut away to illustrate the positioning of the termination subassembly within the housing.
Figure 3G:
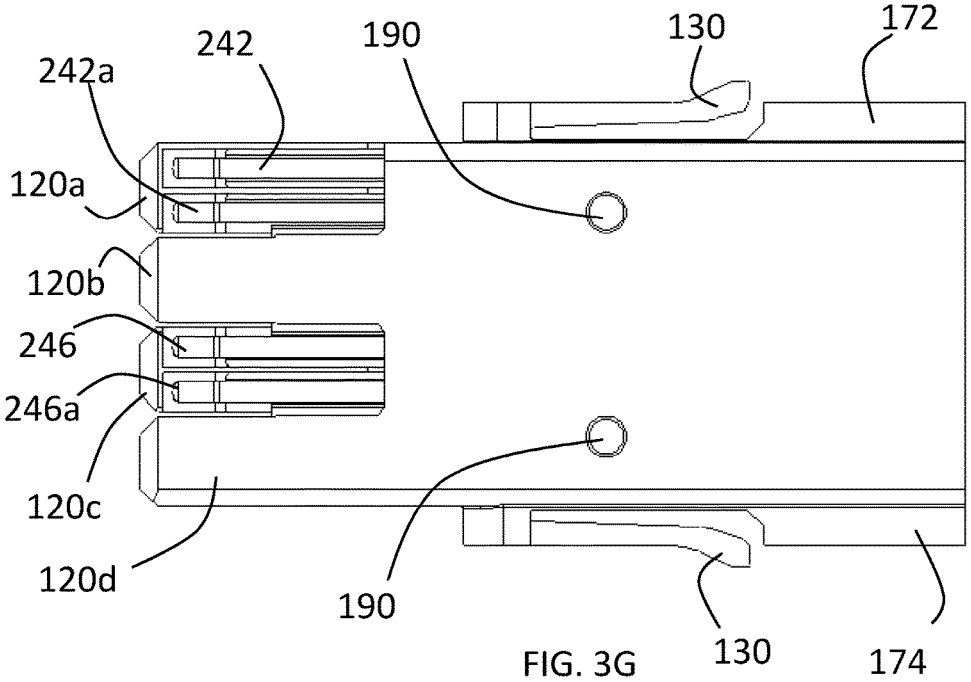
FIG. 3G is a bottom view of a high speed data contact set in accordance with a preferred embodiment of the present invention.
Figure 3H:
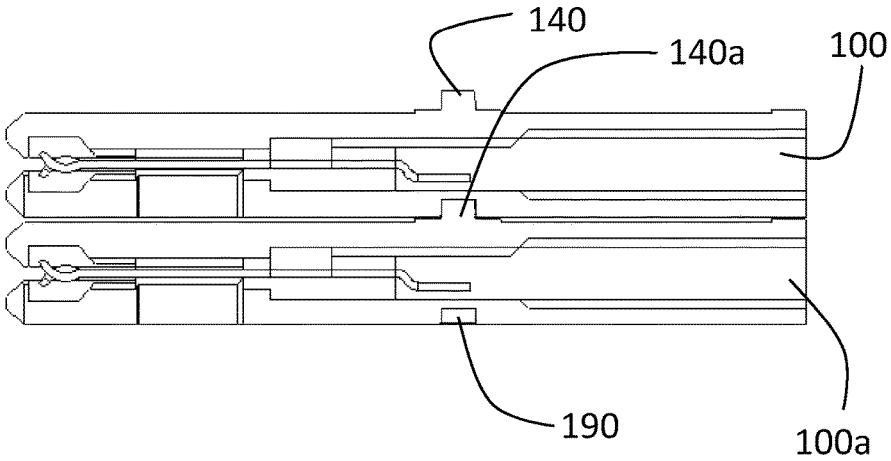
FIG. 3H is a cross-sectional view of a stacked pair of high speed data contact sets in accordance with a preferred embodiment of the present invention prior to injection of potting material into the housing.

In FIG. 3A, the termination subassembly 200 is shown aligned with a housing 100 for insertion of the termination subassembly 200 into the housing 100 to form the high speed contact data set. As shown in FIG. 3A, the termination subassembly, for example, may have beveled corners on the top or bottom to align with corresponding structures on the interior of the housing 100 to ensure that the termination subassembly is inserted into the housing in the proper orientation. The high speed data contact set 300 is shown in FIGS. 3B-3H. The protective arms 120*a*, 120*b*, 120*c* and 120*d* each cover one side of a pair of contacts. In this manner the shroud protects the contact beams. Viewed from the top as shown in FIG. 3D, contact pairs 244*a*, 244 and 248*a*, 248 are exposed while contact pairs 242, 242*a* and 246, 246*a* are respectively covered by protective arms 120*a* and 120*c*. Viewed from the bottom as shown in FIG. 3G, contact pairs 242, 242*a* and 246, 246*a* are exposed while contact pairs 244*a*, 244 and 248*a*, 248 are covered by protective arms 120*b* and 120*d* respectively. A shown in FIG. 3G, the bottom side of the housing body 110 has holes or depressions 190 for receiving raised bosses 140 when two or more high speed data contact sets are stacked. The raised bosses 140 and accommodating holes or hollows 190 allow for the chiclets to be stacked and by having two raised bosses prevents rotation of the chiclets relative to one another, thereby allowing a stacked assembly of chiclets to be inserted into a module simultaneously with ease. An exemplary stack of two high speed data contact sets 100 and 100*a* are shown in FIG. 3H in cross-section form to illustrate the placement of raised bosses 140*a* extending from the top of high speed data contact set 100*a* into the holes or depressions 190 in the bottom of high speed data contact set 100. When a stack of a plurality of high speed data contact sets is being assembled, the raised bosses 140 on the top of the top-most high speed data contact set may be removed, such as by sanding, to allow other stacks of high speed data contact sets or other types of contacts to be installed in a module adjacent the stack of high speed data module contact sets.

Figure 3J:
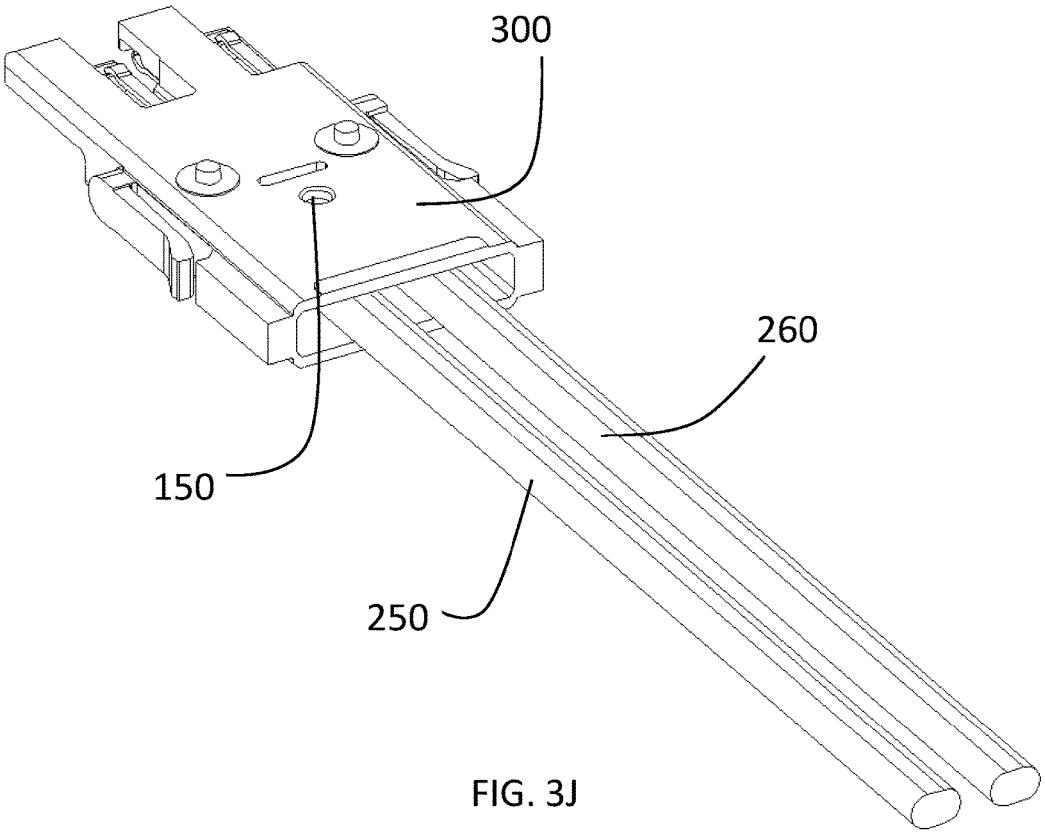
FIG. 3J is a perspective view of a wired high speed data contact set in accordance with a preferred embodiment of the present invention prior to injection of potting material into the housing.
Figure 3K:
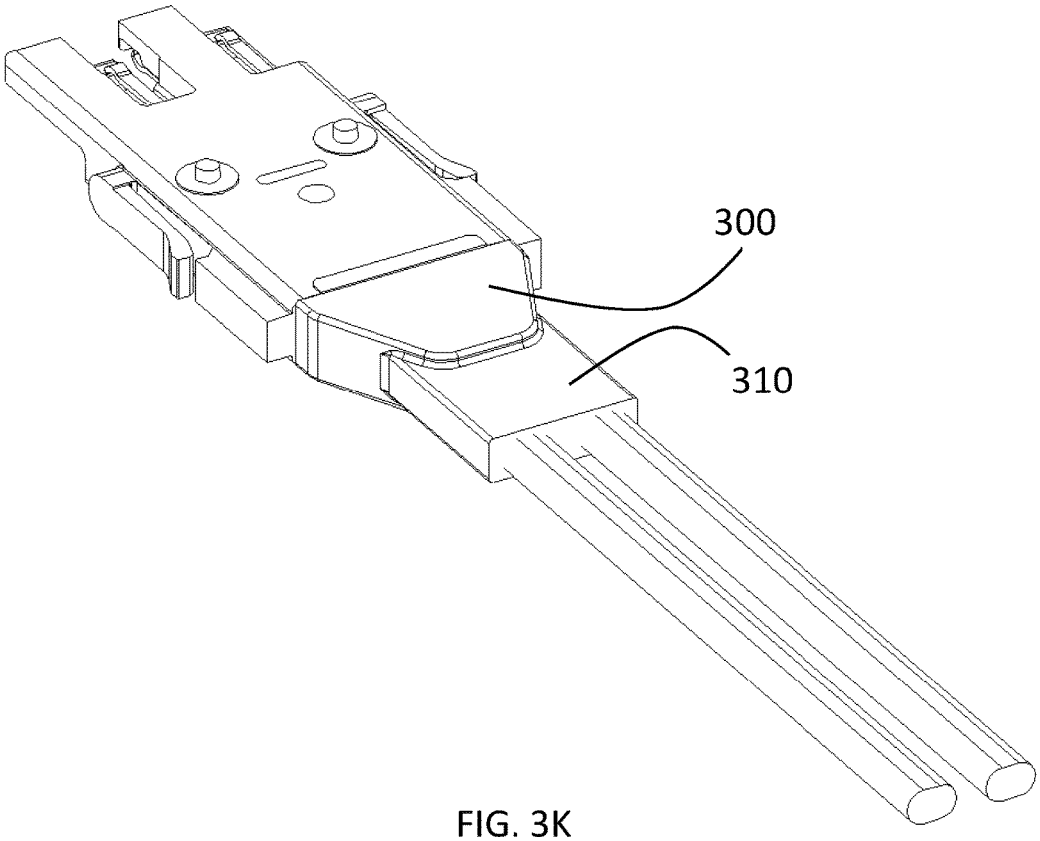
FIG. 3K is a perspective view of a wired high speed data contact set in accordance with a preferred embodiment of the present invention after injection of potting material into the housing.
Figure 3L:
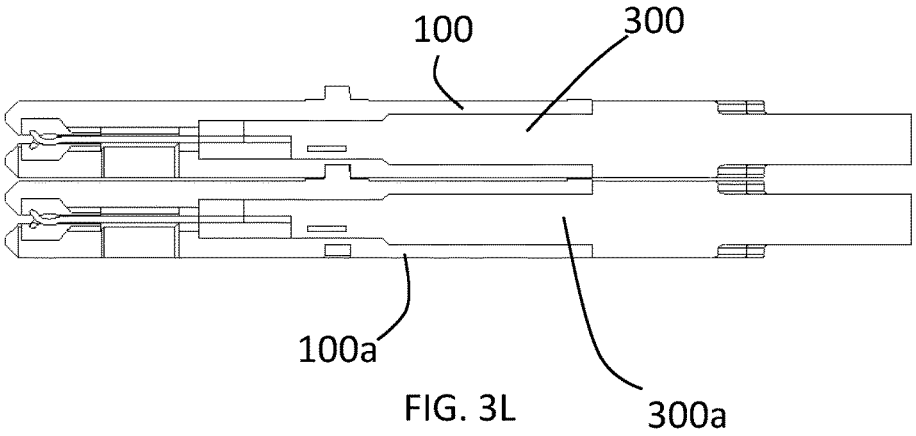
FIG. 3L is a cross-sectional view of a stacked pair of high speed data contact sets in accordance with a preferred embodiment of the present invention after injection of potting material into the housing.
Figure 3M:
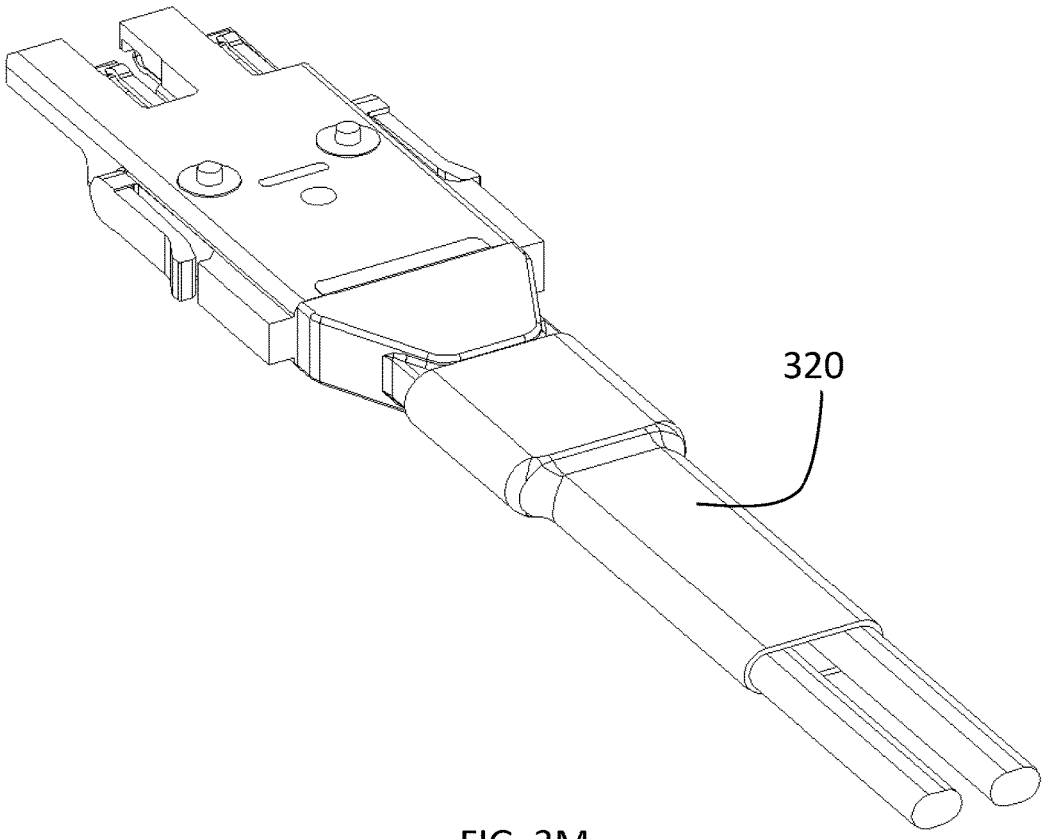
FIG. 3M is a perspective view of a completed assembly of a wired high speed data contact set in accordance with a preferred embodiment of the present invention after injection of potting material into the housing.

A high speed data contact set of the present invention is shown in FIG. 3J with a wired termination subassembly inserted into a housing 100. Potting material is injected into the hole 150 in the housing body 110 to surround the termination subassembly inside the housing body 110 and to fill open space within the housing body 110. The potting material 300 extends outside the housing body 110 to form a neck 310, which protects the connections between the wire bundles 250, 260 and the contacts in the termination subassembly. FIG. 3L is a cross-section illustrating the interior of high speed contact data sets 100 and 100*a* in a stacked configuration with potting material 300 and 300*a* with the respective housing bodies. After the potting material 300 is in place, a protective material 320 is placed around the potting material extending out of the housing body 100 and the wire bundles 250, 260.

Figure 4A:
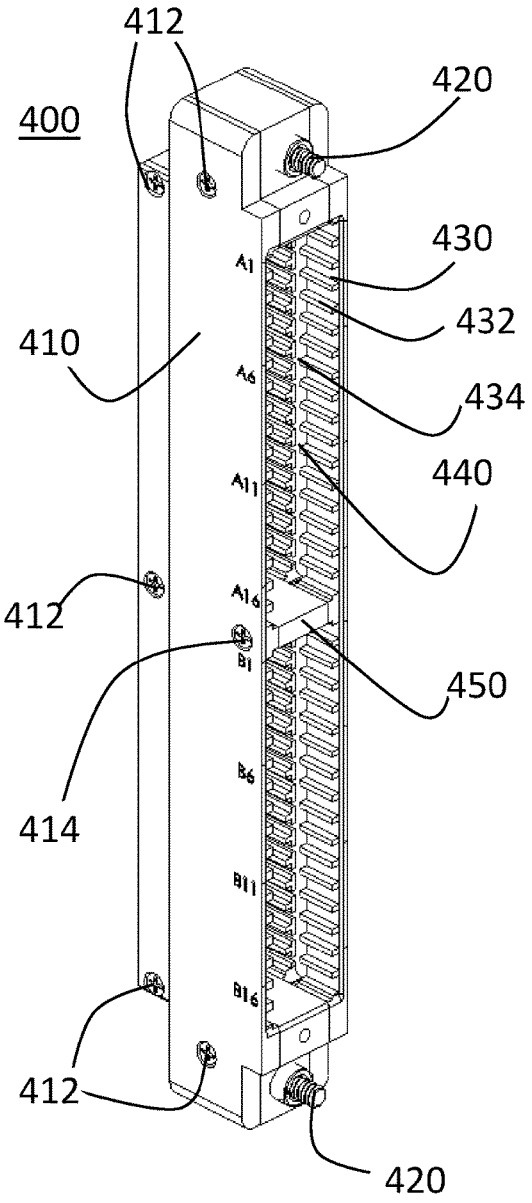
FIG. 4A is a rear perspective view of an interface module adapted to accommodate a high speed data contact set in accordance with a preferred embodiment of the present invention.
Figure 4B:
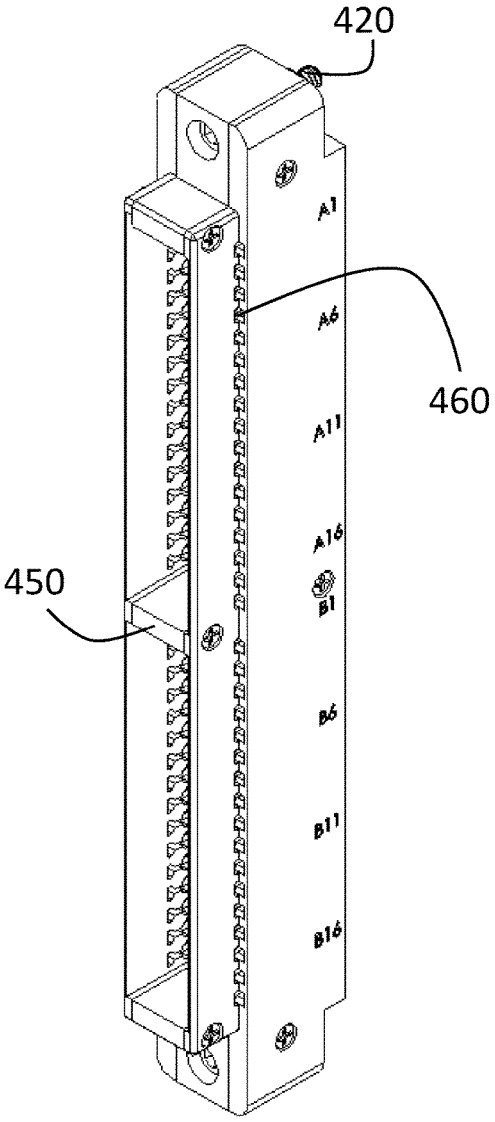
FIG. 4B is a front perspective view of an interface module adapted to accommodate a plurality of high speed data contact sets in accordance with a preferred embodiment of the present invention.

Insertion of a chiclet into a module will be described with reference to FIGS. 4A-4E. A module adapted to house a plurality of high speed data contact sets is shown in FIGS. 4A and 4B. The module has a frame 410 and a plurality of screws 412 connecting different portions of the module 400 together. At each end of the module frame 410 is a screw 420 for connecting the module to an interface receiver frame or interface test adapter frame. The module 400 additionally has a support member 450 connected to the module frame 410 by screws 414. In the interior of the module, there are a plurality of slots 430 for receiving high speed data contact sets. The slots 430 are defined by a plurality of ridges 432 on opposing sides of the module frame 410. The slots on the two opposing sides of the module are of differing widths to accommodate the different sized keying elements 172, 174 on the high speed data contact set housing 110. On each of the two opposing sides of the module 400 there is a slot 434 running along the length of the module. The slot 434 may be formed by gaps in the ridges 432. On the front face of the module on each side of the open portion into which the chiclets are inserted, there are a plurality of holes 460 with one hole on each side of the opening corresponding to each slot 430. These holes 460 will be described below in connection with removal of chiclets from the module.

Figure 4C:
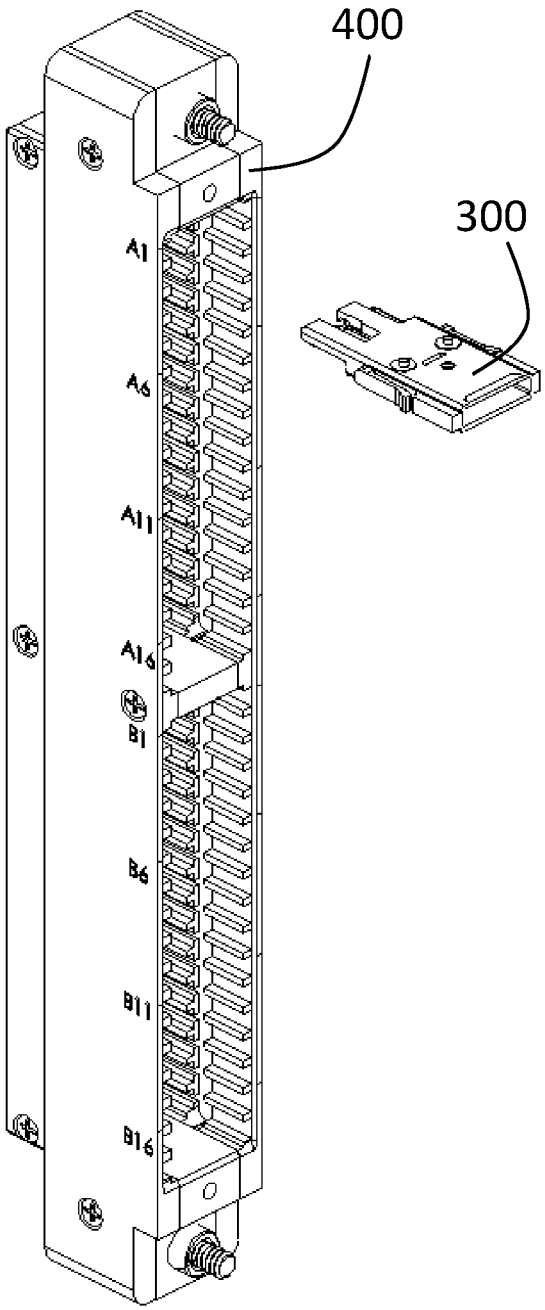
FIG. 4C is a rear perspective view of an interface module adapted to accommodate a plurality of high speed data contact sets in accordance with a preferred embodiment of the present invention with a high speed data contact set aligned for insertion into the interface module.
Figure 4D:
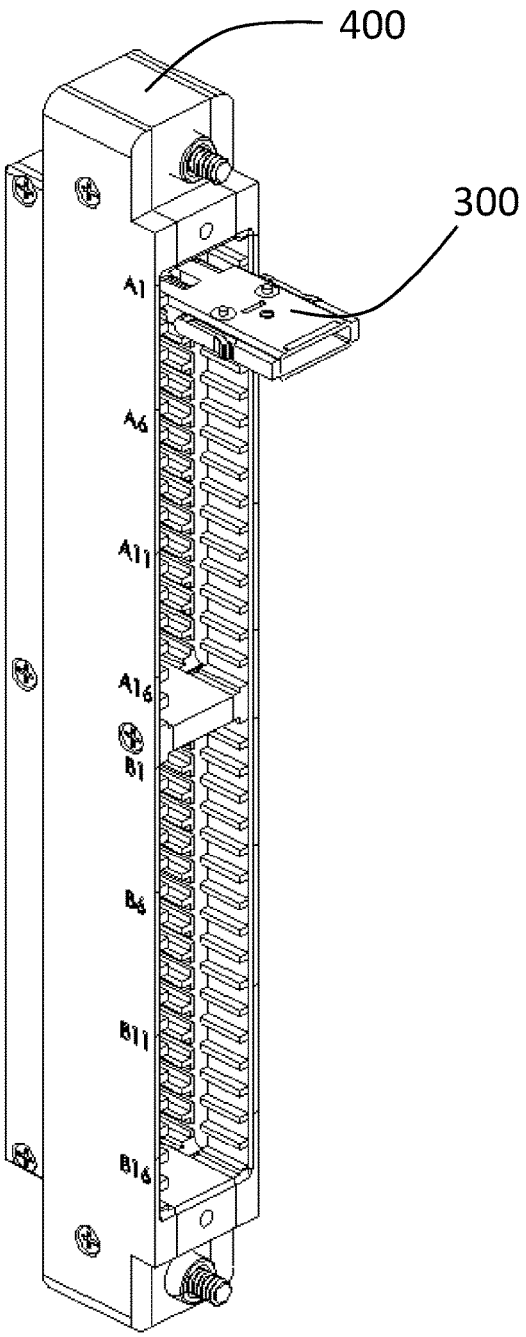
FIG. 4D is a rear perspective view of an interface module adapted to accommodate a plurality of high speed data contact sets in accordance with a preferred embodiment of the present invention with a high speed data contact partially inserted into the interface module.
Figure 4E:
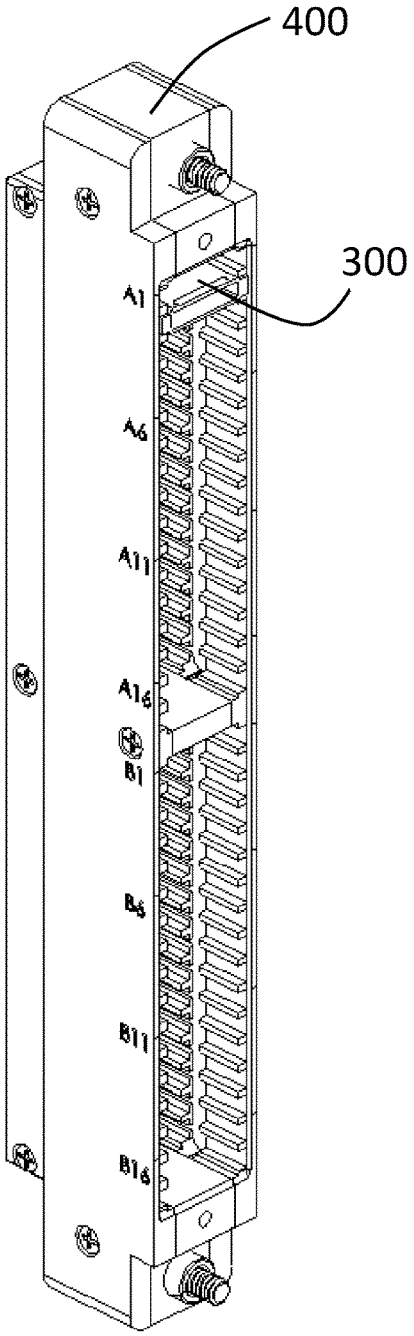
FIG. 4E is a rear perspective view of an interface module adapted to accommodate a plurality of high speed data contact sets in accordance with a preferred embodiment of the present invention with a high speed data contact fully inserted into the interface module.

As shown in FIG. 4C, a high speed data contact set 300 is aligned with one of the slots 430 in the module 400. The high speed data contact set 300 is pushed into the slot 430, as show in FIG. 4D, until the latches 130 on the housing body 110 snap into the slot 434 running along the length of the module frame 410 as shown in FIG. 4E. A plurality of high speed data contact sets, or chiclets, may be stacked as shown in FIGS. 3H and 3L and be inserted into a module 400 as a stack or group of chiclets.

Figure 5A:
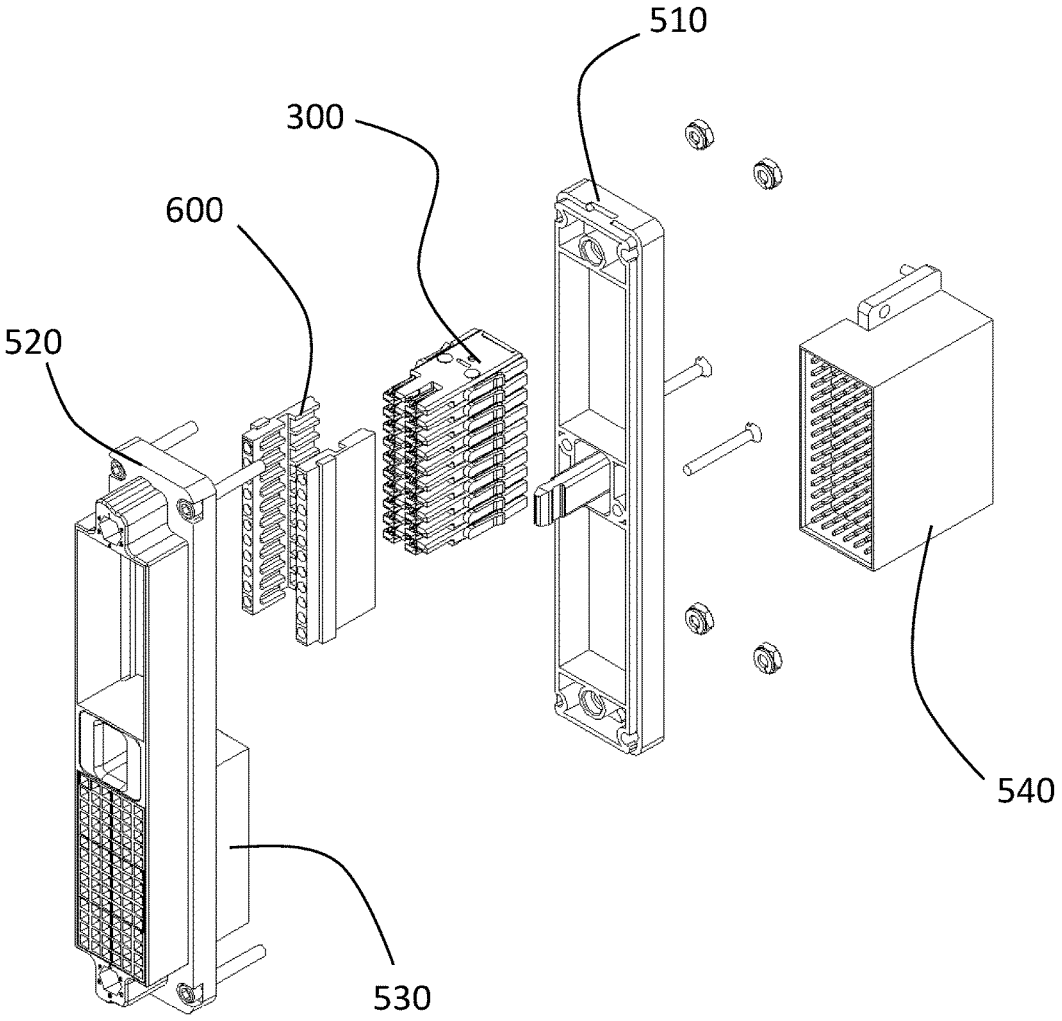
FIG. 5A is an assembly drawings of a receiver of an interface system adapted to accommodate a plurality of high speed data contact sets in accordance with a preferred embodiment of the present invention.
Figure 5B:
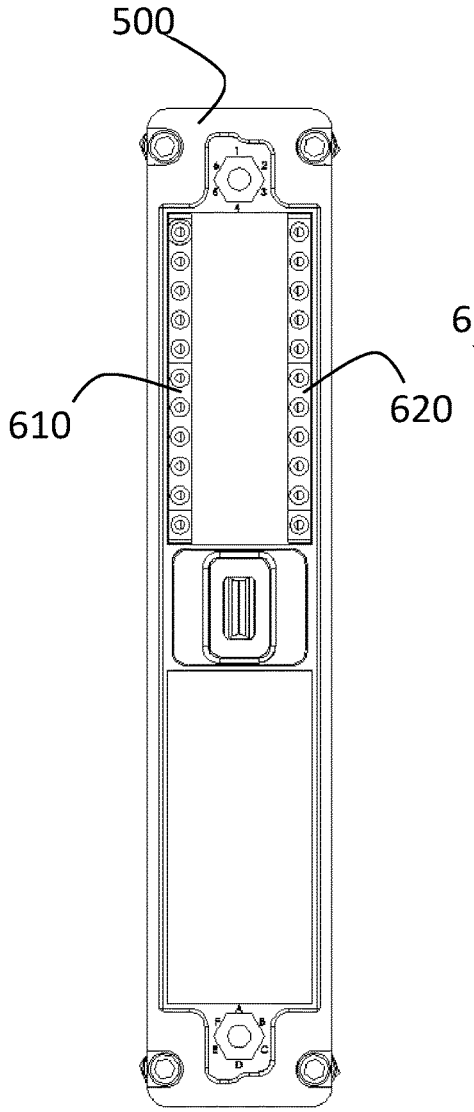
FIG. 5B is a front view of an interface receiver frame adapted to accommodate a plurality of high speed data contact sets in accordance with a preferred embodiment of the present invention.

The high speed data contact set can be used with various module form factors such that it can be used in a multitude of mass interconnect and high life-cycle engagement systems. An arrangement for the chiclets to be installed in a different type of interface device is shown in and described with respect to FIGS. 5A and 5B. A receiver frame 500 has a back half 510 and a front half 520 that can be connected to one another, for example with screws. The back half of the receiver frame 510 has an engagement mechanism 512, such as, for example, the engagement mechanisms disclosed and described in U.S. Patent Application Publication No. 2010/0194417 or U.S. Pat. No. 8,348,693. The receiver frame 500 has a plurality of positions for inserting contacts of different types. In FIG. 5A, an 84-position Quadrapaddle module insert 530 and an 84 position header 540 from Virginia Panel Corporation are shown in the lower portion of the receiver frame 500. In the upper portion of the receiver frame 500 is a high speed insert module adapter 600 and a stack of high speed data contact sets or chiclets 300. Different arrangements, such as the insert module adapter 600 in the lower half of the receiver frame 500 rather that the top, insert module adapters 600 in both the upper and lower portions, or the insert module adapter 600 in one of the upper or lower portions and some other type of adapter in the other portion will be apparent to those of skill in the art.

Figure 6:
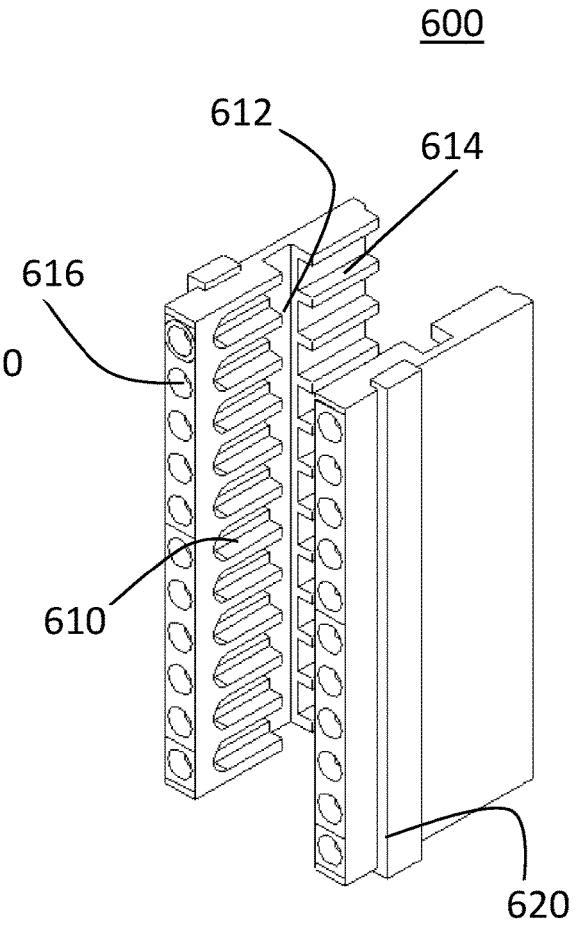
FIG. 6 is a perspective view of an adapter insert for an interface receiver frame to accommodate a plurality of high speed data contact sets in accordance with a preferred embodiment of the present invention.

The insert module adapter 600 is shown in FIG. 6. The insert module adapter 600 has a first side 610 and a second side 620. Each side 610, 620 has a plurality of slots 612 for receiving chiclets. The slots 612 on the first and second sides may be of different sizes to accommodate keying elements 172, 174 on the chiclet housing body 110. As with the prior module, the slots 612 may be formed from a plurality of ridges or may be grooves in the wall of the insert module adapter. Additionally, there is a groove or slot along the length of the insert module adapter—perpendicular to the slots 612—for receiving the latches 132 of the chiclet housing body 110.

To remove the high speed data module sets 300 from a module, an extraction tool is a used. The extraction tool removes a chiclet from the front of a module rather than the rear of the module, thereby allowing an operator to remove a chiclet from a module without first removing the module from the interface receiver or interface test adapter. An extraction tool 700 in accordance with the present invention is shown in FIGS. 7A-7I. The extraction tool has upper and lower body portions 710 and 710*a*. The upper and lower body portions are identical to one another. Each body portion 710, 710*a* has a pair of alignment posts 712, 712*a* and alignment holes 714, 716, 714*a*, 716*a*. Additional holes 718, 718*a* optionally may be included. The two body portions 710, 710*a* are connected to one another with two pairs of screws 720, 720*a*. The screws extend through holes 724, 724*a* in the upper and lower body portions 710, 710*a* and into holes 722, 722*a* having interior raised portions 726*a* When a plurality of extraction tools 700 are stacked to extract a plurality of chiclets from a module, the alignment posts 712 in one tool are placed into the holes 714, 716 in an adjacent extraction tool. The hole 716 is slightly elongated compared to hole 714 to provide a limited amount of float when a plurality of extraction tools are stacked.

Figure 7A:
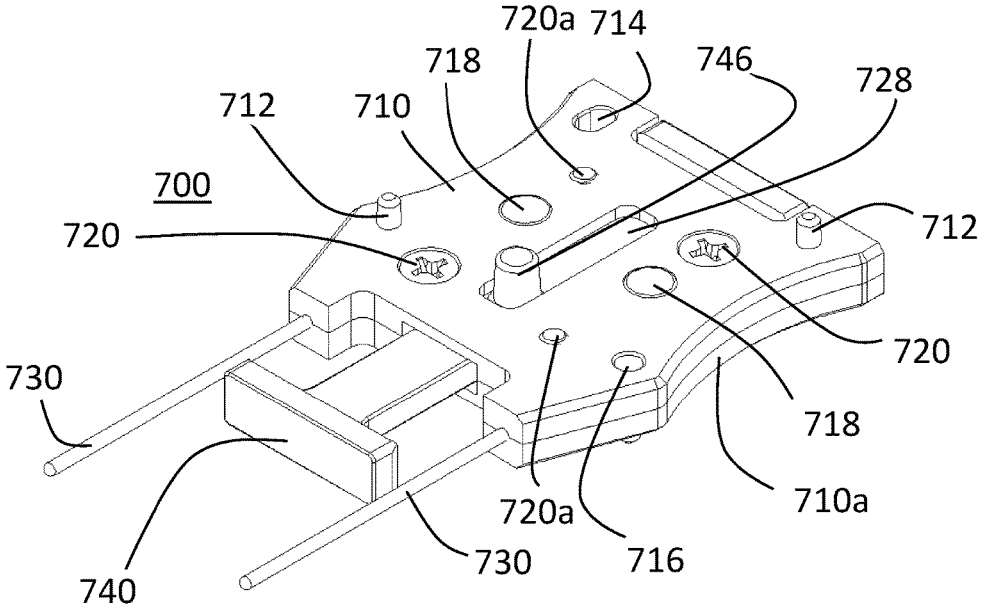
FIG. 7A is a top perspective view of an extraction tool for extracting a high speed data contact set from a module in accordance with a preferred embodiment of the present invention.
Figure 7B:
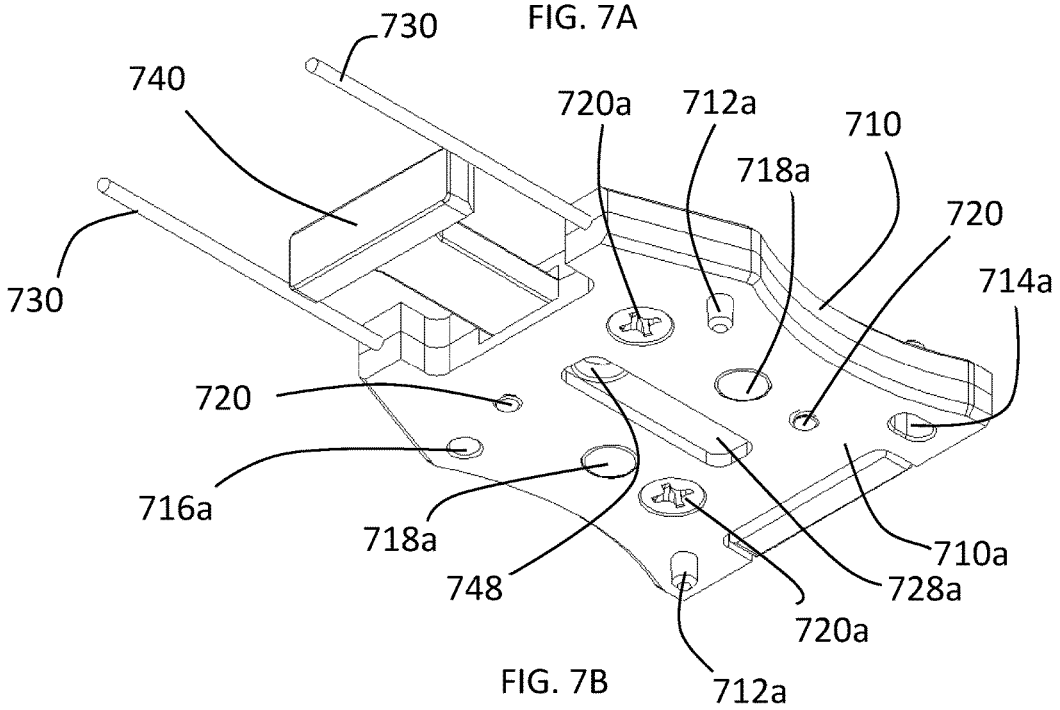
FIG. 7B is a bottom perspective view of an extraction tool for extracting a high speed data contact set from a module in accordance with a preferred embodiment of the present invention.
Figure 7C:
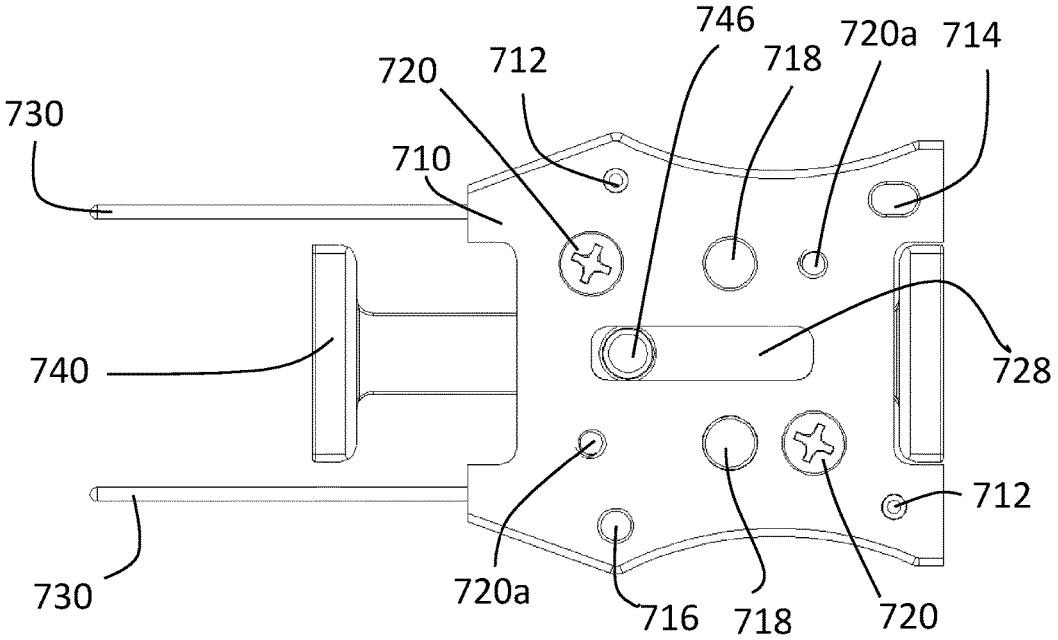
FIG. 7C is a top view of an extraction tool for extracting a high speed data contact set from a module in accordance with a preferred embodiment of the present invention.
Figure 7D:
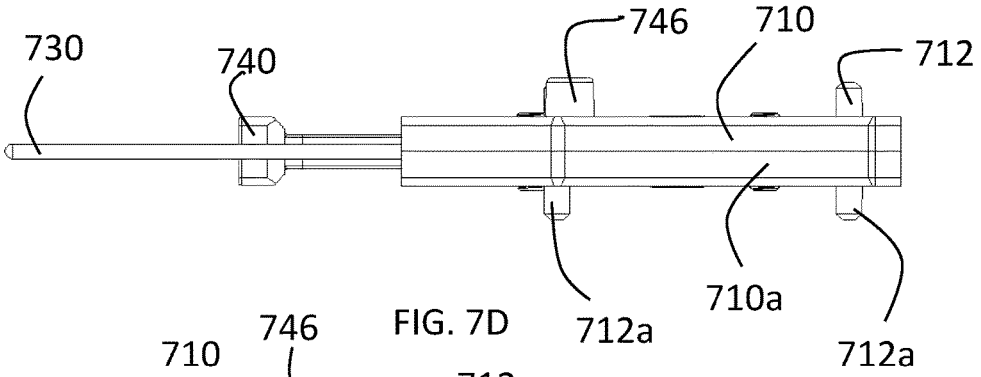
FIG. 7D is a first side view of an extraction tool for extracting a high speed data contact set from a module in accordance with a preferred embodiment of the present invention.
Figure 7E:
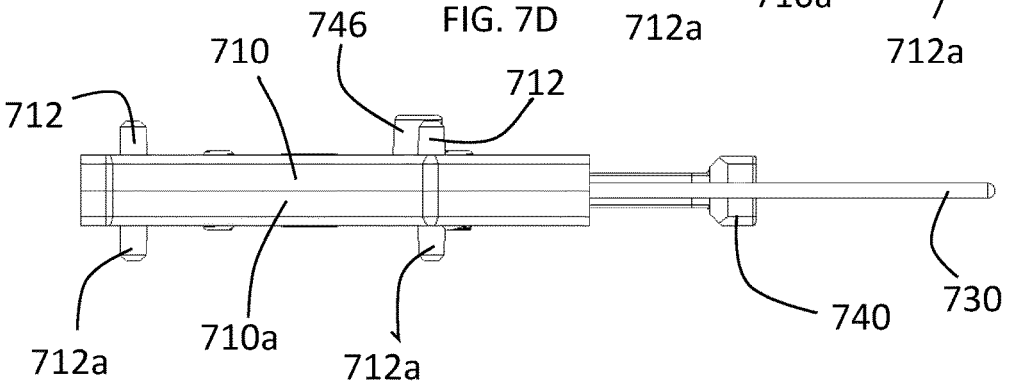
FIG. 7E is a second side view of an extraction tool for extracting a high speed data contact set from a module in accordance with a preferred embodiment of the present invention.
Figure 7F:
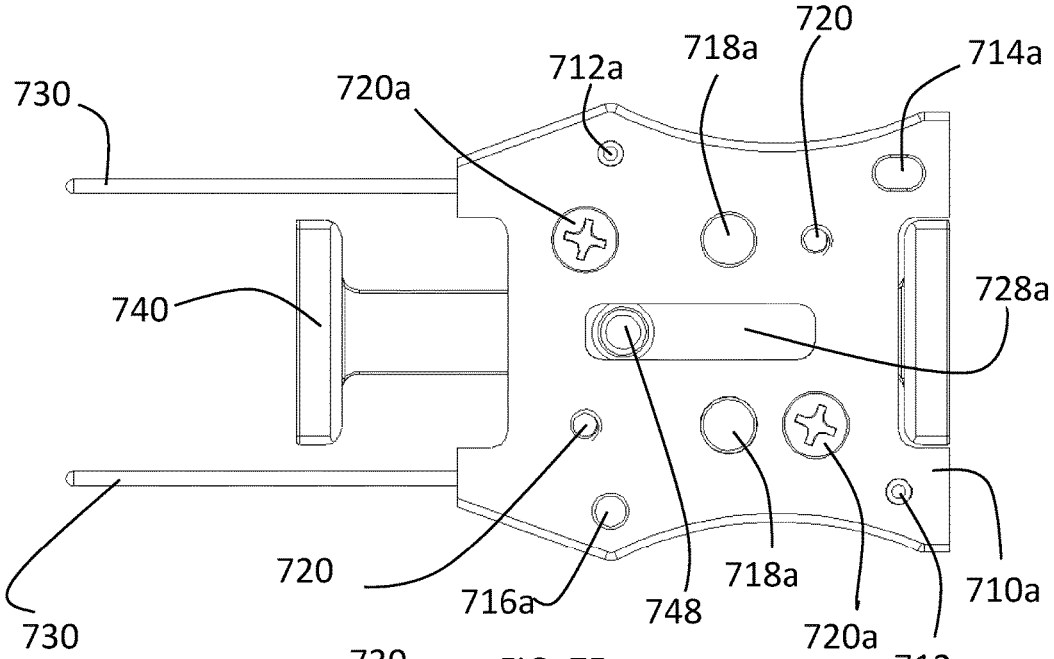
FIG. 7F is a bottom view of an extraction tool for extracting a high speed data contact set from a module in accordance with a preferred embodiment of the present invention.
Figure 7G:
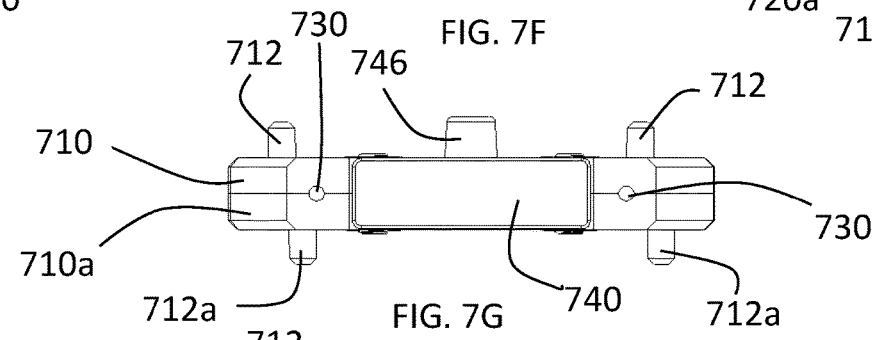
FIG. 7G is a front view of an extraction tool for extracting a high speed data contact set from a module in accordance with a preferred embodiment of the present invention.
Figure 7H:
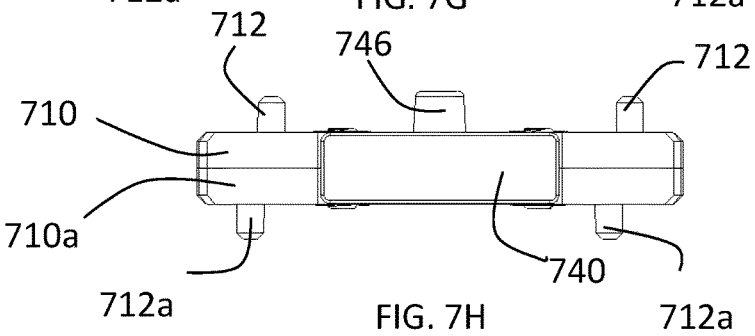
FIG. 7H is a rear view of an extraction tool for extracting a high speed data contact set from a module in accordance with a preferred embodiment of the present invention.
Figure 7I:
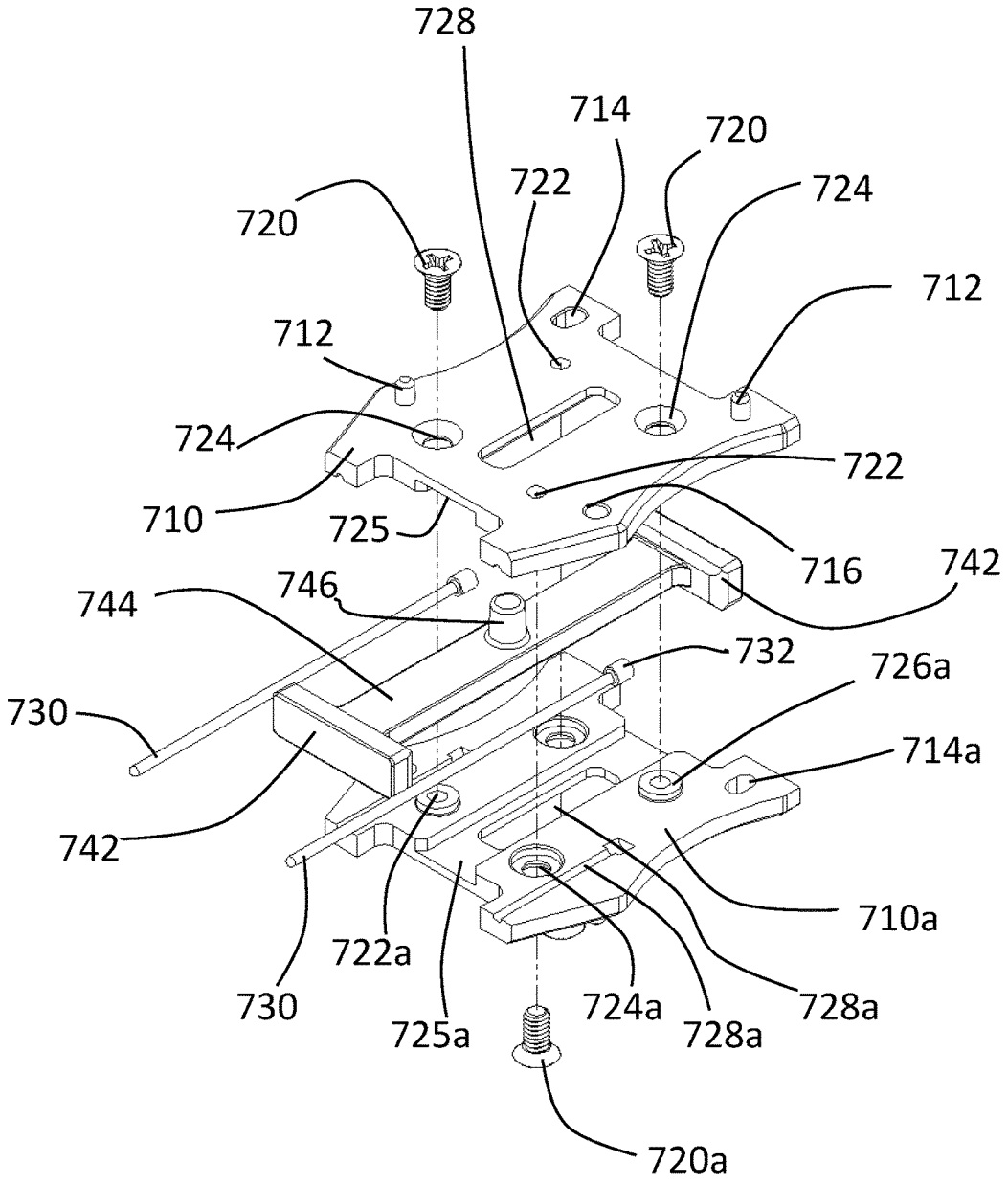
FIG. 7I is an assembly view of an extraction tool for extracting a high speed data contact set from a module in accordance with a preferred embodiment of the present invention.

Mounted within the extraction tool are a pair of release pins 730 that extend from the front of the extraction tool 700. Each release pin 730 has a portion that sits within a groove in the extraction tool body, as shown in FIG. 7I. The proximal end of each release pin 730 has an enlarged portion 732 that sits within an enlarged groove portion and prevents the release pin 730 from sliding into or out of the extraction tool 700. The release pins are replaceable. Slidably mounted within the extraction tool 700 is a plunger 740. The plunger 740 has a shaft 744 with flat portions 742 at opposing ends. Extending from the middle portion of the shaft 744 is post 746 that extends upward through the slot 728 to extend out of the top of the extraction tool 700. When the extraction tool 700 is fully assembled, the plunger 740 slides within the extraction tool. The post 746 is used by the operator of the extraction tool to move the plunger 740 between first and second positions. The bottom side of the plunger 740 has an opening 748 to a cavity in the interior of the post 746. When a plurality of extraction tools are stacked, the post 746 of one extraction tool extends through the slot 728*a* and opening 748 and into the cavity of the post 746 in the extraction tool just above it in the stack. With this configuration, an operator can move the plungers of a plurality of extractions tools simultaneously so as to remove a stack of a plurality of chiclets.

Figure 8A:
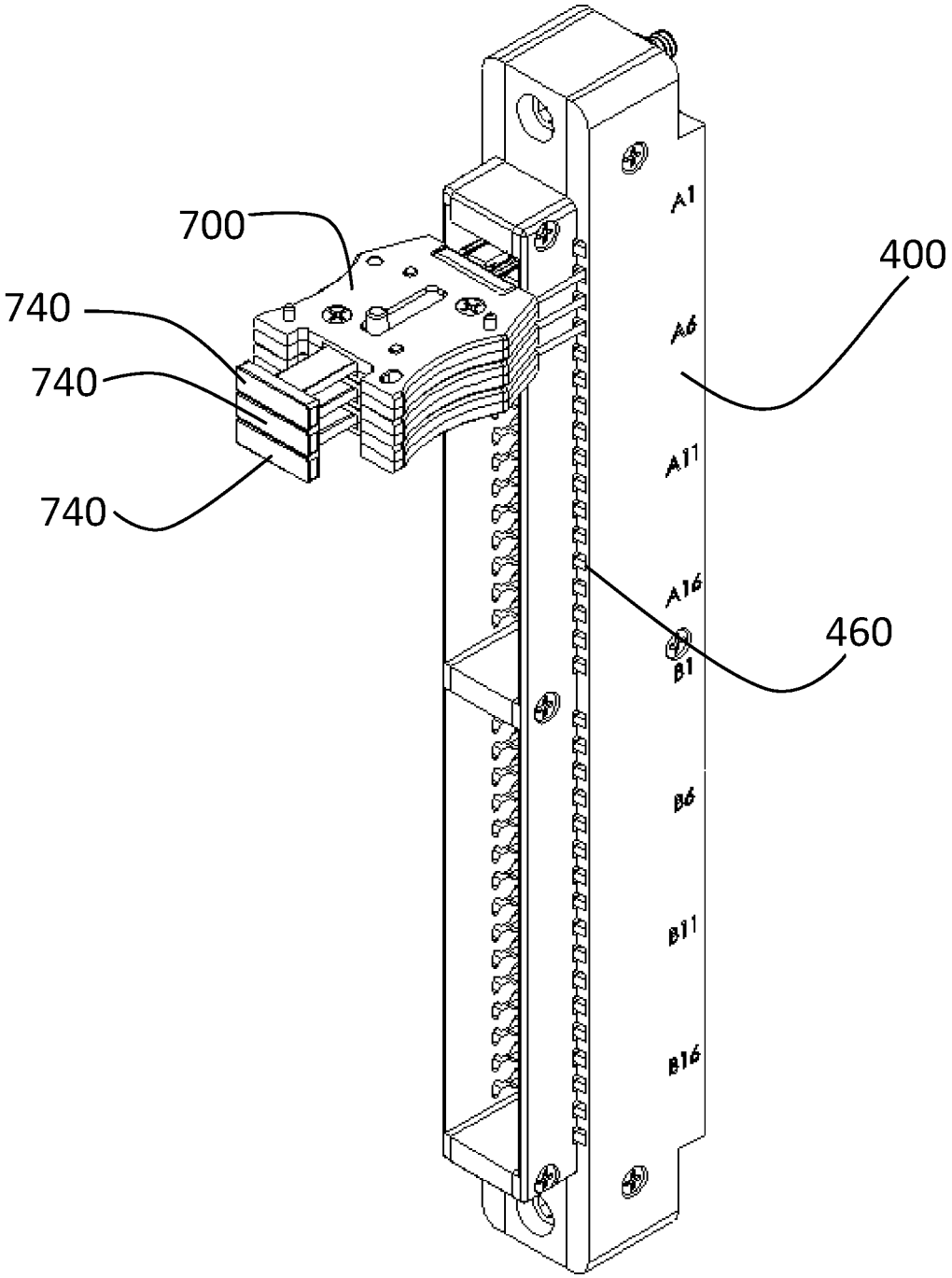
FIG. 8A is a perspective view of a plurality of extraction tools aligned to extract a plurality of high speed data contact sets from an interface module in accordance with a preferred embodiment of the present invention.
Figure 8B:
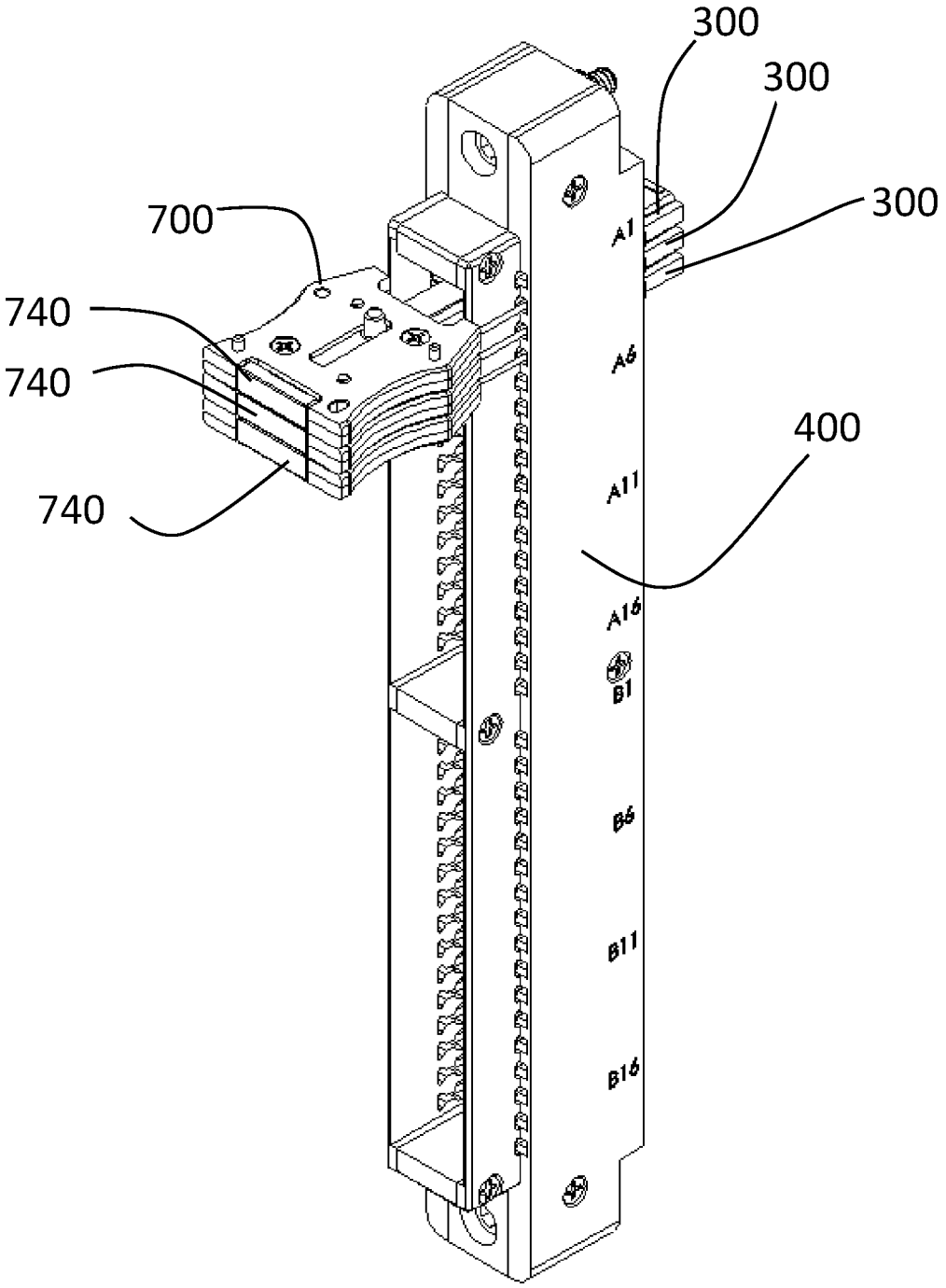
FIG. 8B is a perspective view of a plurality of extraction tools aligned to extract a plurality of high speed data contact sets from an interface module in accordance with a preferred embodiment of the present invention with the high speed data contact sets disengaged from the module.

The use of the extraction tool is shown in FIGS. 8A-8B. In FIG. 8A, a stack of three extraction tools 700 is aligned with three chiclets in the module. The release pins 730 of each extraction tool 730 are aligned with an inserted into a hole 460 corresponding to a slot in which one of the chiclets is mounted. When the release pins 130 are inserted into the holes 460, they press on the portion 132 of a latch 130 of the Chiclet, thereby releasing the latches 130 from the slots 440 in the module 400. As the release pins 730 are pushed into the holes 460, the body of each extraction tool moves closer to the chiclets and the plunger 740 of each extraction tool is pushed by the chiclet to the position shown in FIG. 8A. Once the release pins are fully inserted into the holes 460 and the latches 130 of each of the chiclets has been released, the operator pushes the plungers 740 to push the chiclets 300 out of the module, as shown in FIG. 8B. The extraction tool and the latches on the chiclet allow for re-programmability of an interface system. In other words, by removing, adding or changing chiclets in a module, an operator can reconfigure the input/output, I/O of the module.

An alternative embodiment of the present invention is shown in FIGS. 9A-9M. In the alternative embodiment, a first chiclet has a twin beam separable structure. The twin beam design allows for a separable interface to a right angle termination insert, which offers a variety of terminations such as through hole straight mount, printed circuit board, PCB, through hole right angle PCB, compliant pin straight PCB, compliant pin right angle PCB and discrete wire termination configurations.

Figure 9A:
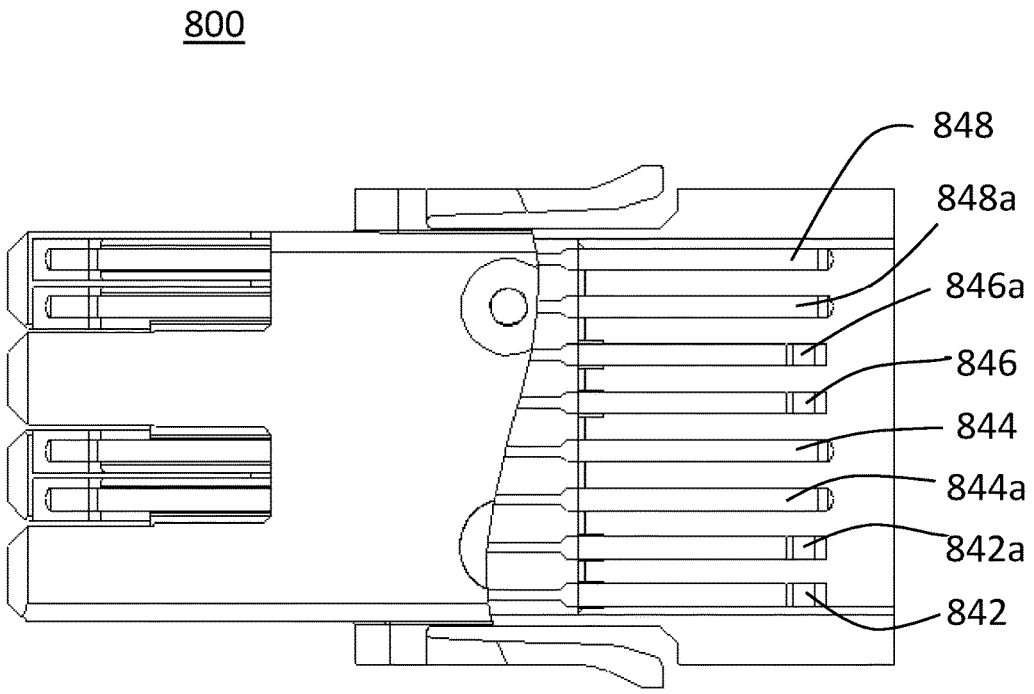
FIG. 9A is a partial top cross-sectional view of an alternative embodiment of a high speed data contact set for use with a right angle high speed contact set in accordance with a preferred embodiment of the present invention.
Figure 9B:
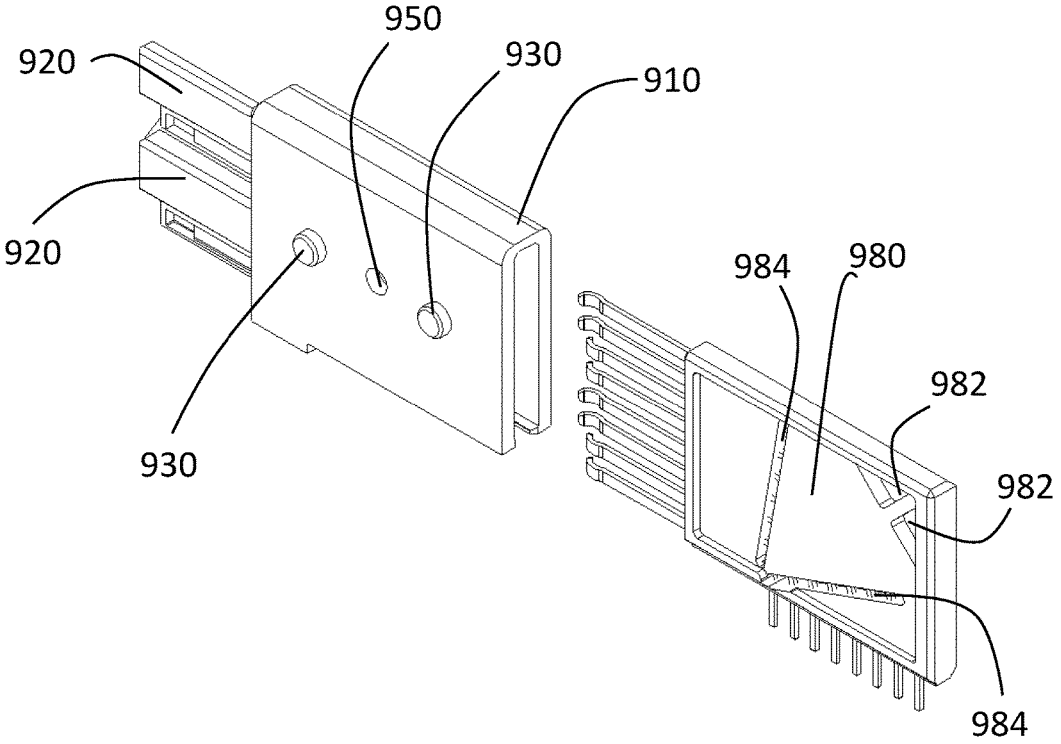
FIG. 9B is a perspective assembly view of a right angle high speed contact set in accordance with a preferred embodiment of the present invention.
Figure 9C:
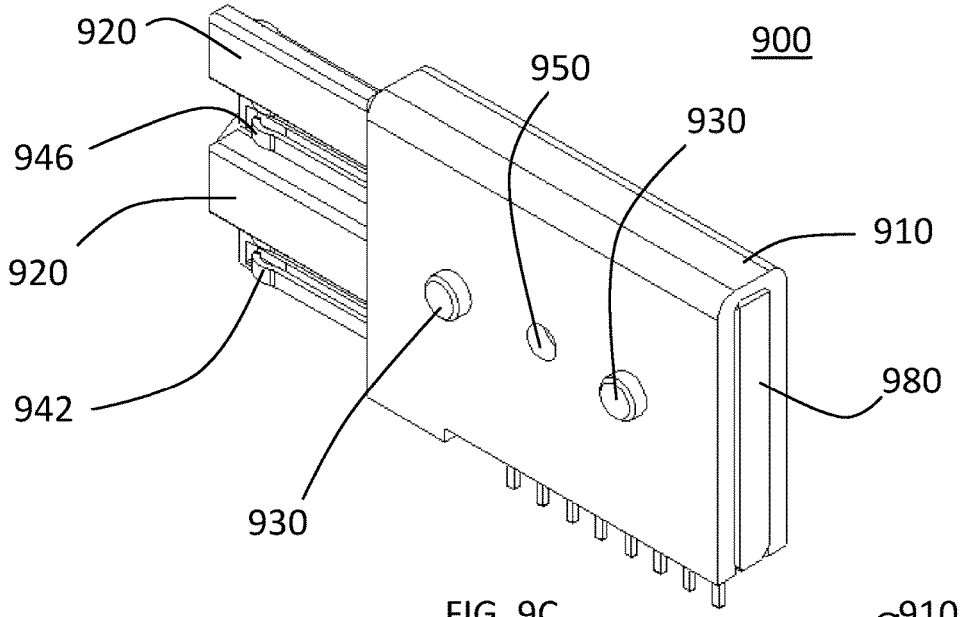
FIG. 9C is a perspective view of a right angle high speed contact set in accordance with a preferred embodiment of the present invention.
Figure 9D:
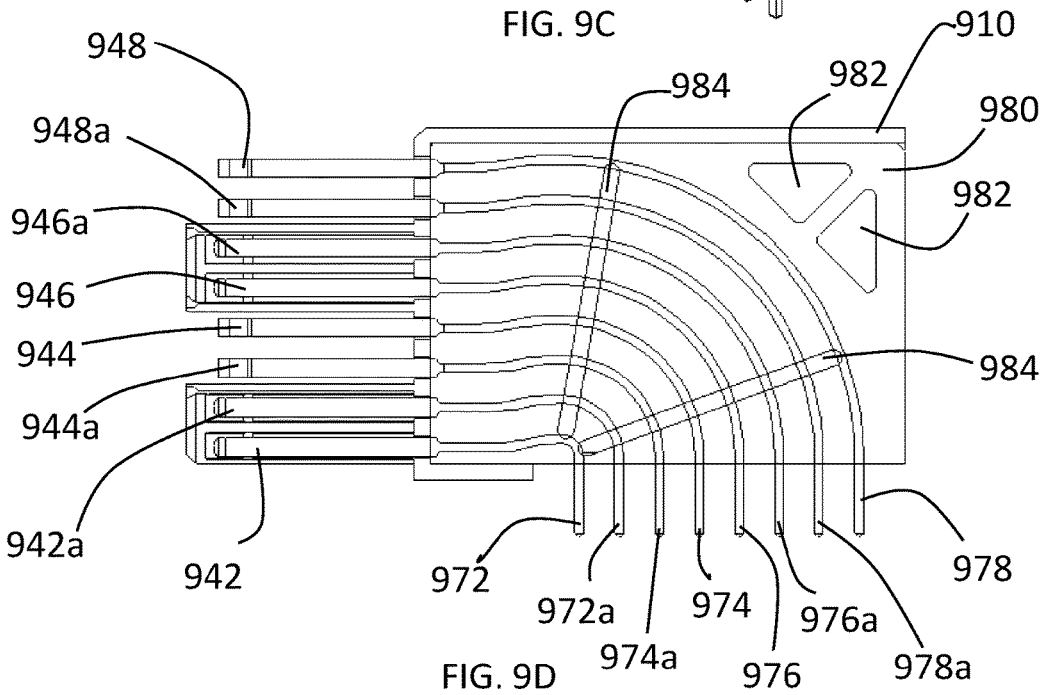
FIG. 9D is a cross-sectional view of a right angle high speed contact set in accordance with a preferred embodiment of the present invention.
Figure 9E:
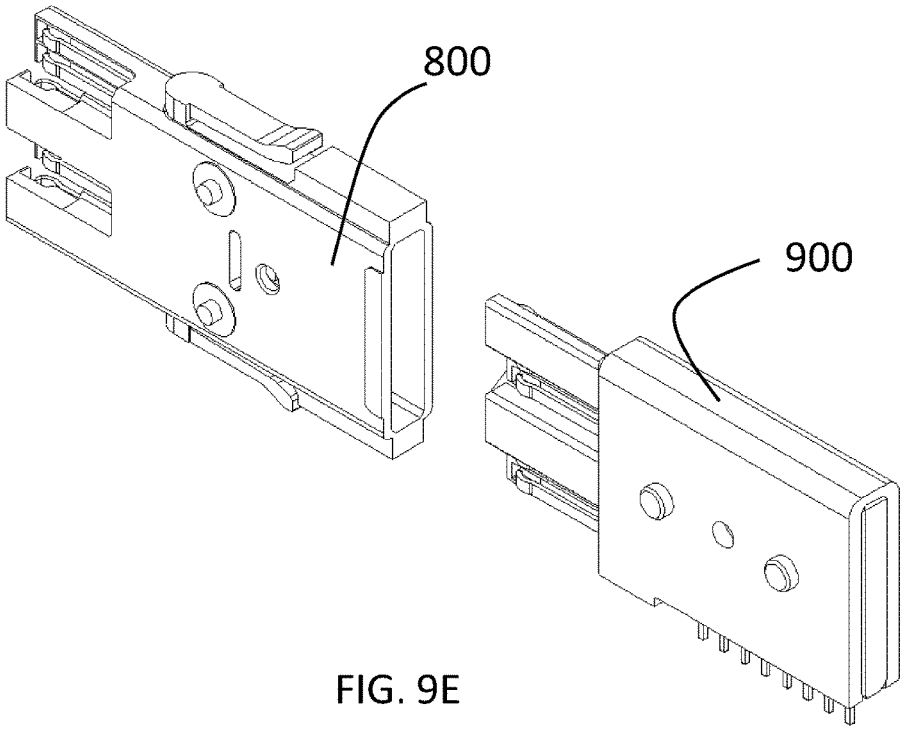
FIG. 9E is a perspective view of an alternative embodiment of a high speed data contact set aligned for connection with a right angle high speed contact set in accordance with a preferred embodiment of the present invention.
Figure 9F:
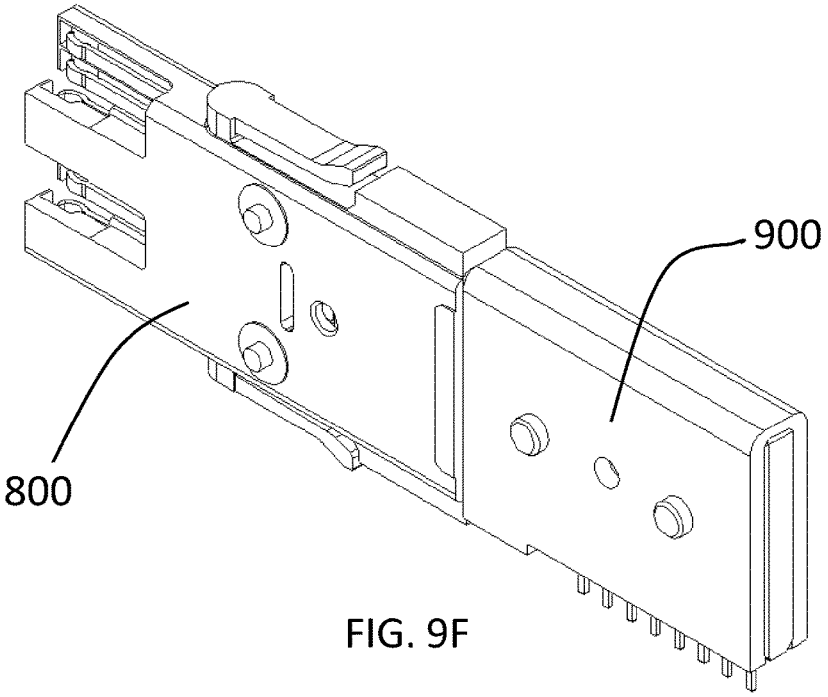
FIG. 9F is a perspective view of an alternative embodiment of a high speed data contact set connected to a right angle high speed contact set in accordance with a preferred embodiment of the present invention.
Figure 9G:
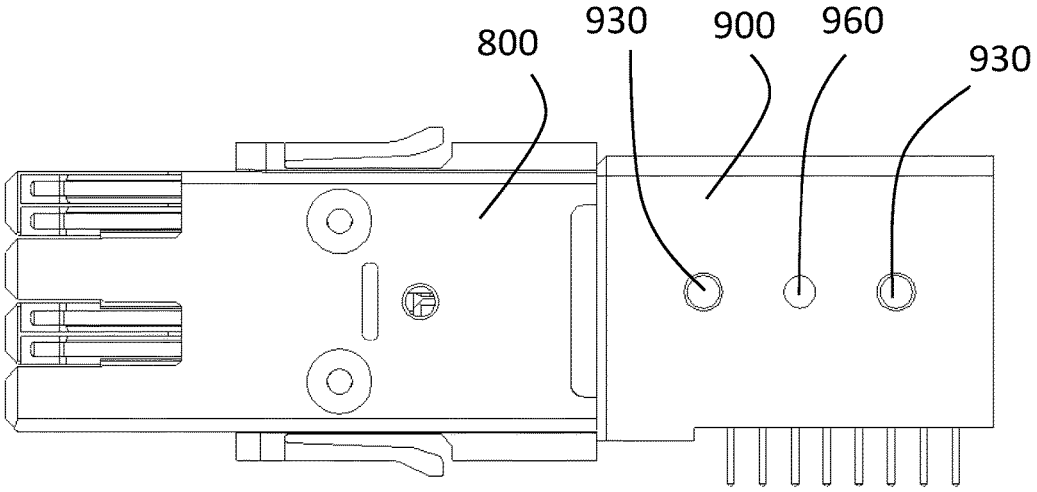
FIG. 9G is a top view of an alternative embodiment of a high speed data contact set connected to a right angle high speed contact set in accordance with a preferred embodiment of the present invention.
Figure 9H:
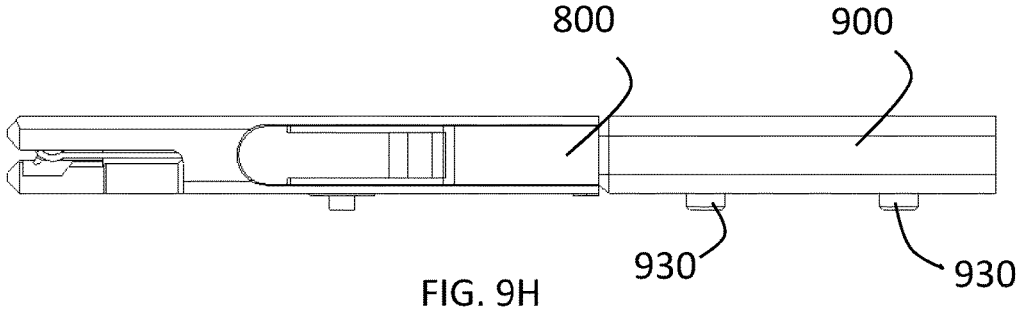
FIG. 9H is a first side view of an alternative embodiment of a high speed data contact set connected to a right angle high speed contact set in accordance with a preferred embodiment of the present invention.
Figure 9I:
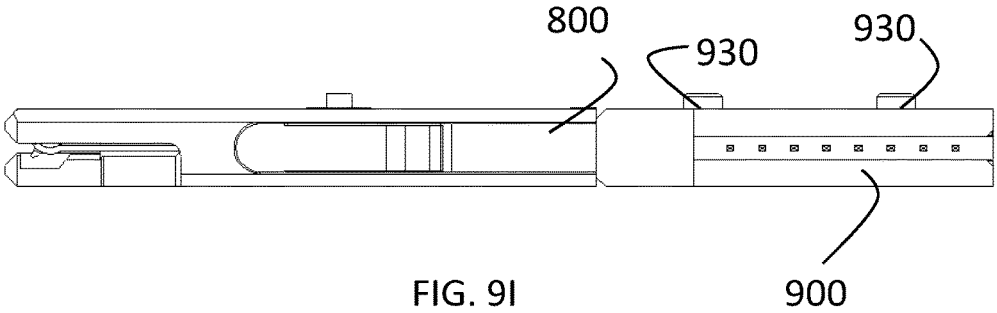
FIG. 9I is a second side view of an alternative embodiment of a high speed data contact set connected to a right angle high speed contact set in accordance with a preferred embodiment of the present invention.
Figure 9J:
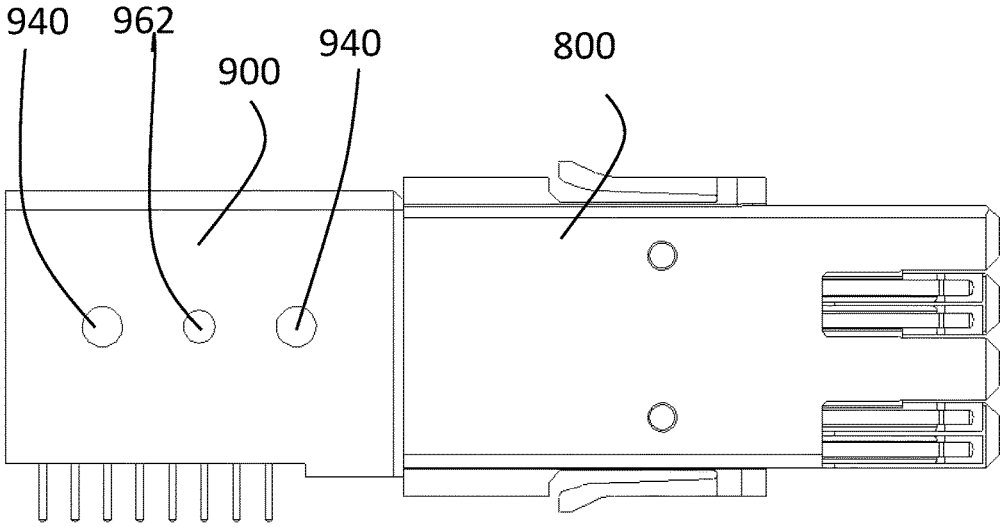
FIG. 9J is a bottom view of an alternative embodiment of a high speed data contact set connected to a right angle high speed contact set in accordance with a preferred embodiment of the present invention.
Figure 9K:
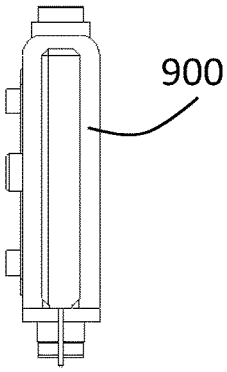
FIG. 9K is a rear view of an alternative embodiment of a high speed data contact set connected to a right angle high speed contact set in accordance with a preferred embodiment of the present invention.
Figure 9L:
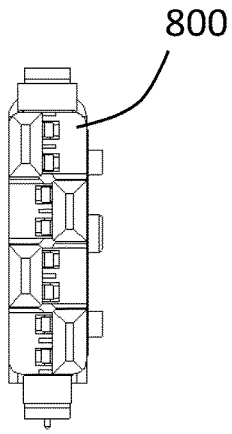
FIG. 9L is a front view of an alternative embodiment of a high speed data contact set connected to a right angle high speed contact set in accordance with a preferred embodiment of the present invention.
Figure 9M:
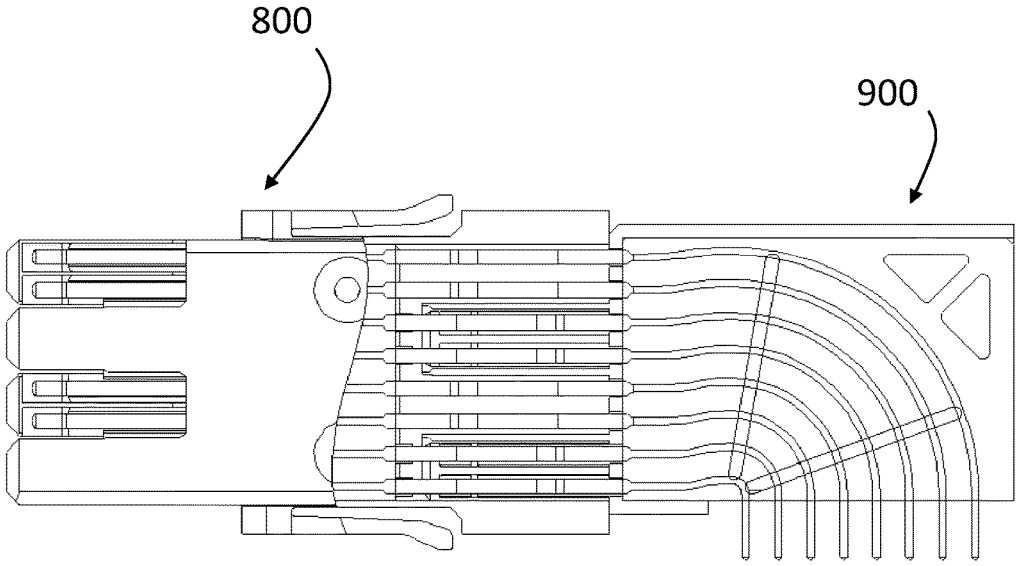
FIG. 9M is a partial cross-sectional view of an alternative embodiment of a high speed data contact set connected to a right angle high speed contact set in accordance with a preferred embodiment of the present invention.

The linear data contact set 800 has a housing 100 identical to that shown and described in FIG. 1. The termination subassembly, however, differs in that instead of the contacts being direct welded at their proximal end to wires, they extend to contact beams 842, 842*a*, 844, 844*a*, 846, 846*a*, 848, 848*a* facing the opposite direction as shown in FIG. 9A. Additionally, no potting material is injected into the housing 110. In this manner, the first chiclet becomes a twin beam separable high speed data module contact set that can removably mate with a second chiclet, which, as shown in FIGS. 9B-9D may be a right-angle high speed data contact set or chiclet 900.

The right-angle termination insert 900 has a U-shaped housing 910 that is placed around a contact insert 980. The contact insert has a plurality of contacts 972, 972*a*, 974*a*, 974, 976, 976*a*, 978*a*, 978 that are over molded, for example, with plastic. The overmold has openings 982 and 984. The opening 982 may be used to remove material (not shown) holding the contacts together during manufacturing. The holes 984 may be used when potting material is injected into the chiclet. The U-shaped housing 910 has alignment posts 930 extending from one side and a hole 960 in that side through which potting material is injected. On the opposite side, U-shaped housing has a pair of holes or depressions 940 for receiving posts 930 of an adjacent right-angle termination insert if the chiclets are placed in a stacked configuration. The opposite side additionally has a hole 962 through which potting material may be injected.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A high speed data contact assembly comprising:

a linear data contact set comprising:

a housing comprising:

a hollow body having a top, a bottom, a distal end, a proximal end, and first side and a second side; and a termination subassembly in said hollow body, said termination subassembly comprising:

a plurality of pairs of parallel contact beams, the contact beams in each pair being of the same orientation and the pairs of contact beams having alternating orientations, wherein each contact beam has a distal end having a first orientation and a proximal end having a second orientation opposite of said first orientation; and a right angle termination insert adapted for insertion into said proximal end of said linear data contact set, said right angle termination insert comprising:

a U-shaped housing; and a right-angle contact insert assembly in said U-shaped housing, said right-angle contact insert assembly comprising:

a plurality of right angle contact beams each having a distal end and a proximal end, wherein said proximal end of each of said plurality of right-angle contact beams extends at a right angle to the distal end of each said contact beam; and over molding over said plurality of right angle contact beams.

2. The high speed data contact assembly according to claim 1, wherein said linear data contact set is hermaphroditic.

3. The high speed data contact assembly according to claim 1, further comprising potting material in said housing with said termination subassembly.

4. The high speed data contact assembly according to claim 1, wherein said over molding comprises plastic.

5. The high speed data contact assembly according to claim 1, further comprising:

a plurality of openings in said over molding; and potting material in said plurality of openings in said over molding.

* * * * *